US007959501B2

(12) United States Patent
Harmon et al.

(10) Patent No.: US 7,959,501 B2
(45) Date of Patent: Jun. 14, 2011

(54) METHOD AND APPARATUS FOR TESTING AND/OR IMPROVING AGILITY AND RESPONSE TIME

(75) Inventors: Andrew P. Harmon, Dayton, OH (US); Kevin D. Bertram, Defiance, OH (US)

(73) Assignee: Get Quick Athletic Traning & Equipment P.L.C., Dayton, OH (US)

( * ) Notice: Subject to any disclaimer, the term of this patent is extended or adjusted under 35 U.S.C. 154(b) by 753 days.

(21) Appl. No.: 11/811,183

(22) Filed: Jun. 9, 2007

(65) Prior Publication Data

US 2008/0051228 A1 Feb. 28, 2008

Related U.S. Application Data

(60) Provisional application No. 60/812,667, filed on Jun. 9, 2006.

(51) Int. Cl.
*A63F 9/24* (2006.01)

(52) U.S. Cl. ..... 463/4; 473/570; 473/445

(58) Field of Classification Search ..... 473/445, 473/570; 463/4
See application file for complete search history.

(56) References Cited

U.S. PATENT DOCUMENTS

2005/0069853 A1* 3/2005 Tyson et al. ..... 434/247
2007/0213126 A1* 9/2007 Deutsch et al. ..... 463/36
2007/0219059 A1* 9/2007 Schwartz et al. ..... 482/8
2007/0232461 A1* 10/2007 Jenkins et al. ..... 482/93
2010/0204615 A1* 8/2010 Kyle et al. ..... 600/595

* cited by examiner

*Primary Examiner* — Pierre E Elisca
(74) *Attorney, Agent, or Firm* — Joseph G. Nauman

(57) ABSTRACT

A method and apparatus for testing and/or training persons, particularly athletes, with regard to reaction time, peripheral vision, foot speed, agility and (in some cases) strength of hand punch/speed or impact. In addition to testing and training persons, the method & apparatus can improve response and/or reaction time to verbal/audible stimuli. Testing and training can be applied in similar fashion to individuals, or groups of individuals, e.g. part or all of a sport team, under direction of a coach or of a testing operator/technician. An initiating stimulus (illumination of a light signal or motion of a 'mounted" ball) provides a start signal to test subjects, who respond to the stimulus, as by touching or striking a blow to a target. Either of these actions will initiate one or more conditions which occur in a predetermined pattern, e.g. to start a timer which is halted by sensing the touch or blow. With multiple trainees, multiple sensing means may be used to detect individual time lapses relative to some or all of the trainees, thus providing a means to compare and evaluate the several response times. The apparatus also may include an optional force-sensing device in the target(s), which can rate & record the force of a striking blow against the associated target, plus time lapse(s).

21 Claims, 24 Drawing Sheets

HAMMER™

AGILITY REACTION REACH BLOCK FORCE

FIG. 16A

SET AGILITY

HOME RANDOM DEFINED AGILITY TEST

FIG. 16B

SET AGILITY TIME 15 20 25 30 35 40 45

FIG. 16C

SELECT HIKE SIGNAL

BALL LITE LITE/BALL

FIG. 16D

REACH BLOCK

HOME

LEFT CENTER RIGHT

FIG. 16E

AGILITY TEST COMP. TIME 0.00

HOME REMAINING HITS 0.0

0.0 SELECTED HITS

HOME SET DRILL BACK 0.0

FIG. 16F

RANDOM AGILITY

START DRILL

CURRENT HITS 0.0
TOTAL HITS 0.0
SELECTED TIME 0:00

HOME BACK SELECT SEC.

FIG. 16G

DEFINED AGILITY

START DRILL

CURRENT HIT 00
TOTAL HITS 00
X SELECTED TIME 0.00

HOME SELECT DRILL BACK SELECT SEC. 0

FIG. 16H 1 2 3 4 5 6

FIG. 16I

FORCE

START DRILL

LITE
BALL

REACTION TIME 0.00
INTENSITY 0.00
MAX FORCE 000
HP 00.00
VELOCITY 00.0

HOME BACK

FIG. 16J 1 2 3 +/-
4 5 6 CLR
7 8 9
0 ENT

FIG. 16K

METHOD AND APPARATUS FOR TESTING AND/OR IMPROVING AGILITY AND RESPONSE TIME

CROSS-REFERENCE TO OTHER APPLICATIONS

This application is based upon, and claims priority of, applicant's Provisional U.S. Patent Application Ser. No. 60/812,667 filed 9 Jun. 2006. Applicant hereby incorporates by reference into this present application the entire disclosure of said Provisional Application Ser. No. 60/812,667 filed 9 Jun. 2006.

BACKGROUND OF THE INVENTION

This invention relates to a method and apparatus for testing and/or training persons, particularly athletes, principally with regard to reaction time, peripheral vision, foot speed, agility and (in some cases) strength of hand punch/speed or impact. The invention provides in addition for testing and for training persons, principally athletes, to improve response and/or reaction time to a stimulus, particularly visual stimuli, although the invention is also useful in connection with training for response to verbal/audible stimuli. The testing and training can be applied similarly to individuals, or groups of individuals, e.g. part or all of a sport team, under direction of a coach or of a testing operator/technician.

SUMMARY OF THE INVENTION

An initiating stimulus is generated, providing a start signal to one or more persons, trainees and/or test subjects (hereinafter referred to generally as "trainee"). The trainee(s) responds to the stimulus, as by touching or striking a blow to a target. The stimulus can be illumination of a light signal, or motion of a 'mounted" ball. Either of these actions will initiate one or more conditions which act in a predetermined pattern. For example, the initiating stimulus can start a timer, which is halted by sensing the touch or blow. In the case of multiple trainees, multiple sensing means may be used to detect individual time lapses relative to some or all of the trainees, thus providing a means to compare and evaluate the several response times.

The invention also may include an optional force-sensing device in the target(s), which can rate and record, the force of the striking blow against the associated target, in addition to time lapse(s). Such data can be temporarily stored in the control processor for review, and be transferred to a digital memory if desired.

The invention is applicable to the training and/or testing of individual players (e.g. track and field athletes), or groups of players as in football, rugby, hockey, lacrosse, soccer, and similar team sports, with appropriate adaptations of targets, sensors, and stimulus generation. Repeatable exercise repetitions (Programs) can be stored into the controls for the system.

Optional features are provided according to the desires of the trainer, coach, or purchaser/owner. A central station or a selected one or more of multiple stations can include additional auxiliary touch pads that can be used for other types of testing or training. Duplicates of a central station can be added to accommodate a team unit, e.g. offensive or defensive linemen, all or certain ones of a backfield group, or to provide competitive training wherein multiple players (trainees) will run a same routine, together or in succession, A central, programmable, processor accepts inputs from the various transducers on the parts of the equipment stations, and drives display(s) which can be observed by the coach or trainer in real time, or by trainees in a review, as digital output screen display(s) which can be stored and recalled, as well as compared, stored, or recorded displayable data. Also, one or more remote stations can be provided with types of proximity sensing as a further accessory, linked via wireless electronics to the processor. Such an option allows players to perform routines that take them away some distance from the central (and physically related) stations. Thus, the scope of the apparatus, as well as its utility, can be further expanded.

In a first embodiment a portable touch screen device is provided for the trainer/coach to select programs stored in the control processor, and to communicate with the processor by (preferably) wireless transmissions using this device. In a second embodiment, hand held programmable touch screen units can be programmed and will function as a hand or Pocket-sized wireless remote controller.

Other features of the invention will be apparent from the drawings and accompanying description, which follows.

BRIEF DESCRIPTION OF THE DRAWINGS

FIGS. 16A-16K are images representing various display screen information which appears on the hand held touch screen device (see FIG. 12) during operation of the apparatus;

DETAILED DESCRIPTION OF PREFERRED EMBODIMENT

Equipment Provided

This apparatus is designed to improve reaction time, peripheral vision, hand speed, and (in certain uses) strength of hand punch, in use in a competitive atmosphere, if desired. It also has the ability (with the use of multiple units and/or satellite stations, as here-in-after explained) to become an agility training device for hands, feet and vision, and to accommodate single or multiple trainees. The punching or touch pad is designed to make the user(s) focus on a small target area. Focusing on a precise area or areas will help improve the overall blow/force delivered by the user or trainee where that measurement is useful.

Figure 1:
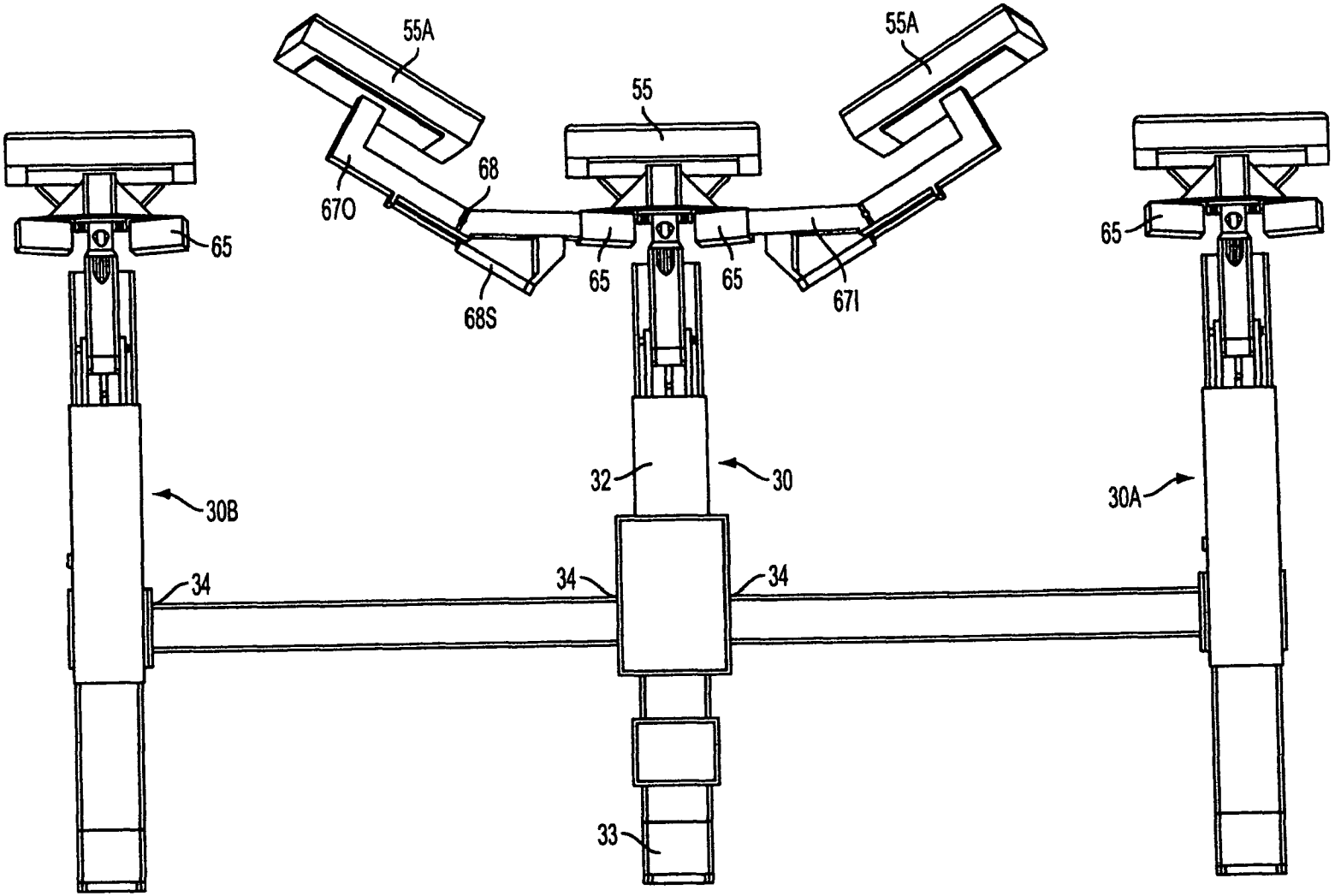
FIG. 1 is a plan view of a typical three-station form of an apparatus provided by the invention.
Figure 2:
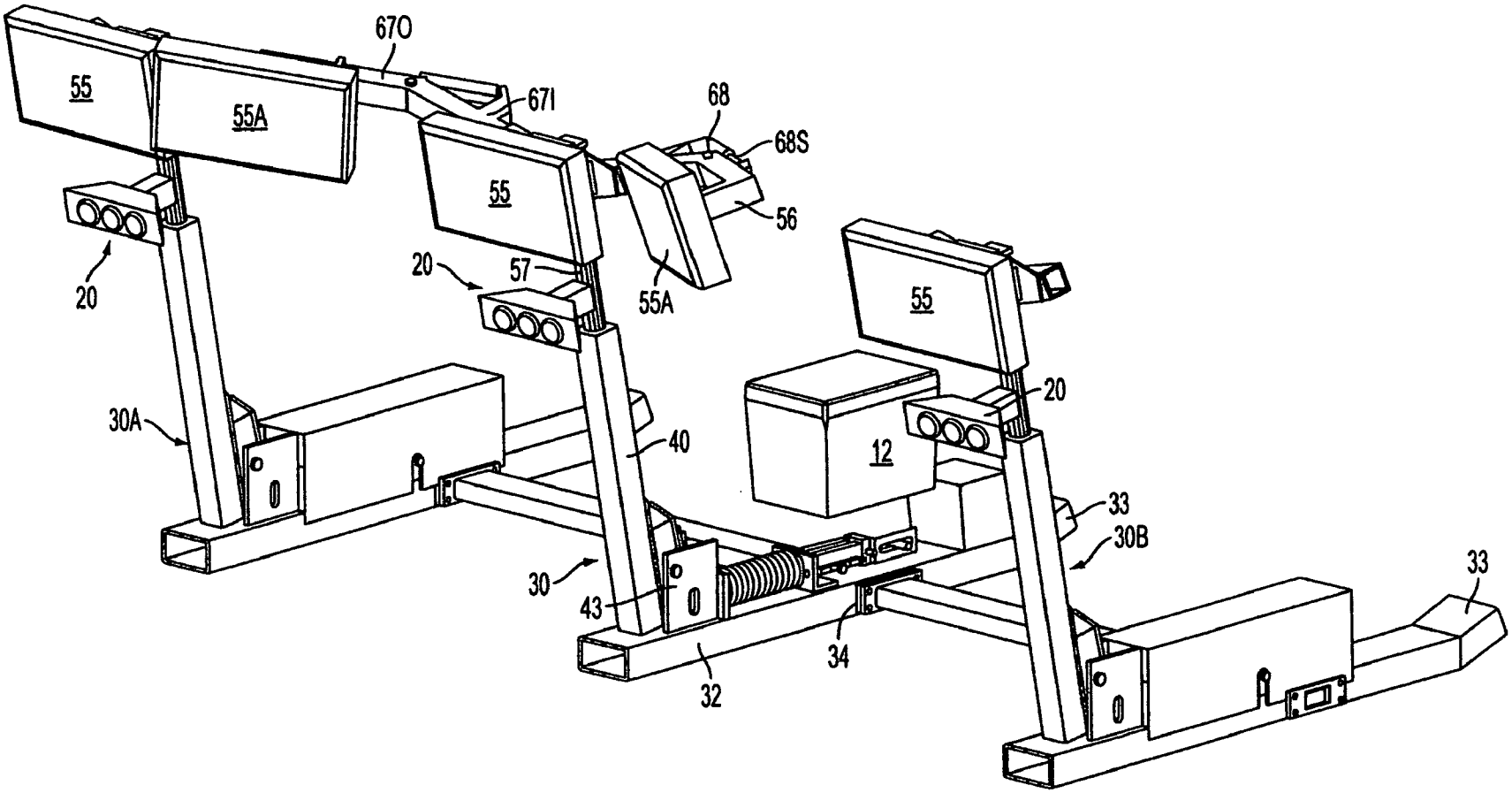
FIG. 2 is a frontal perspective view of the apparatus shown in FIG. 1.
Figure 3:
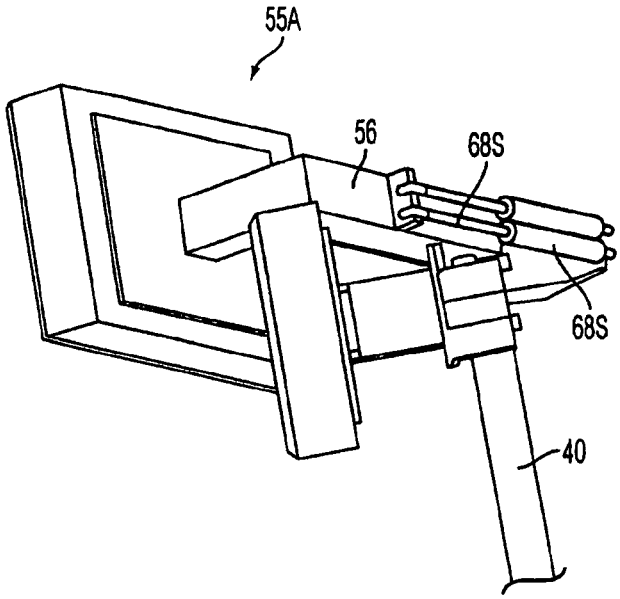
FIG. 3 shows the rear of a auxiliary target fitted to the central station of the apparatus shown in FIG. 1.

Referring to FIGS. 1, 2 and 3, the central station 30, which can be the only (or only active) station of the apparatus in smaller embodiments, comprises a base tubular rail 32 of rectangular, or at least flat bottomed, cross-section, a short rear extension 33 (to facilitate pushing the apparatus over a surface) is fitted to rail 33, and a pair of laterally facing attachment plates 34 are fixed to opposite sides of rail 33. Connecting tubular rails 35, having flanges which can mate with and be bolted to the plates 34, provide connection to additional stations 30A and 30B. Further additional stations can be added if desired, depending upon the size of a group to be trained or tested for group agility and cooperation of a selected set of team members (e.g. offensive or defensive line men, line backers and/or safety men; forwards or defensemen, etc.), in such sports as football, basketball, rugby, soccer, etc. The tubular rails 33, 35, etc. also can function as enclosed races for the wiring extending between parts of the system. When the central station is used alone (or the only one provided), a pair of outrigger tubes (not shown) can be used in place of the connecting rails 35 to provide stability.

A multi-piece upright telescopic post 40 is supported on a pivot mount 42 including side plates 43 and a back plate 44 which are in turn mounted to base rail 32. The upper section 41A of post 40 (FIGS. 1, 2 & 4-8) is vertically and slidably received in a lower post outer section 41B, moving in a passage 42 of irregular cross-section between outer section 41B and an interior post 41C, and held in position by a retaining bolt 41R (see FIG. 5). These sections have matching non-circular cross-sections (FIG. 5), resulting in a substantial torque resistant structure of the telescoping post parts. Thus, if the target and upper post section are raised or lowered, as may be desired, the fit of these parts prevents any appreciable twisting or partial rotation of a target, as might be a result of an off-center hit against the target pad 55, and especially while use of the auxiliary pads 55A by an athlete/trainee.

A pivot bolt 45 extends through side plates 43 and defines the pivot axis of lower post section 41B. At the lowermost back side of post 30, a box-type structure 46 is attached (as by welding) to the lower rear portion of post 40. Pivot bolt passes through this box, thus the post and attached target(s) can rotate or tilt backward, and when the post is returned to its starting position (FIGS. 1, 7 and 8) the bottom of post 40 moves partially into the space between plates 43 clear of the upper surface of rail 32.

Figure 6:
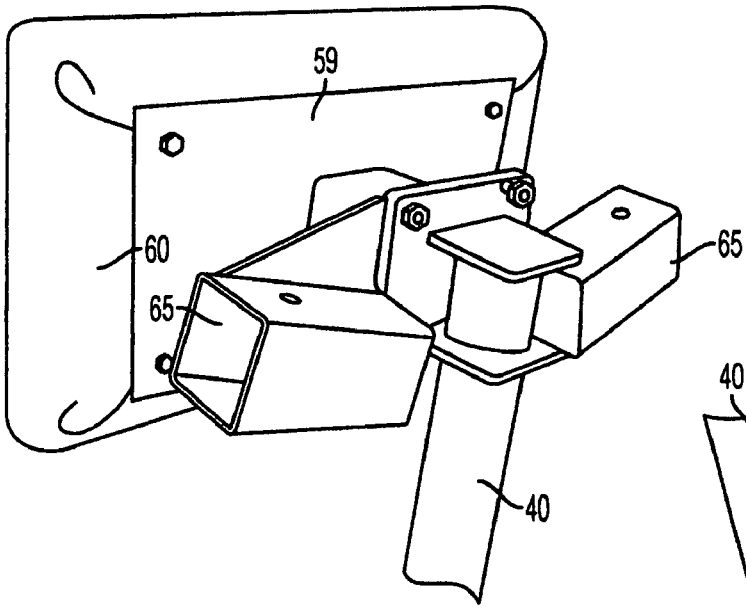
FIG. 6 illustrates details of mounting for various touch and/or striking plates attached to the upper end(s) of the post construction.
Figure 7:
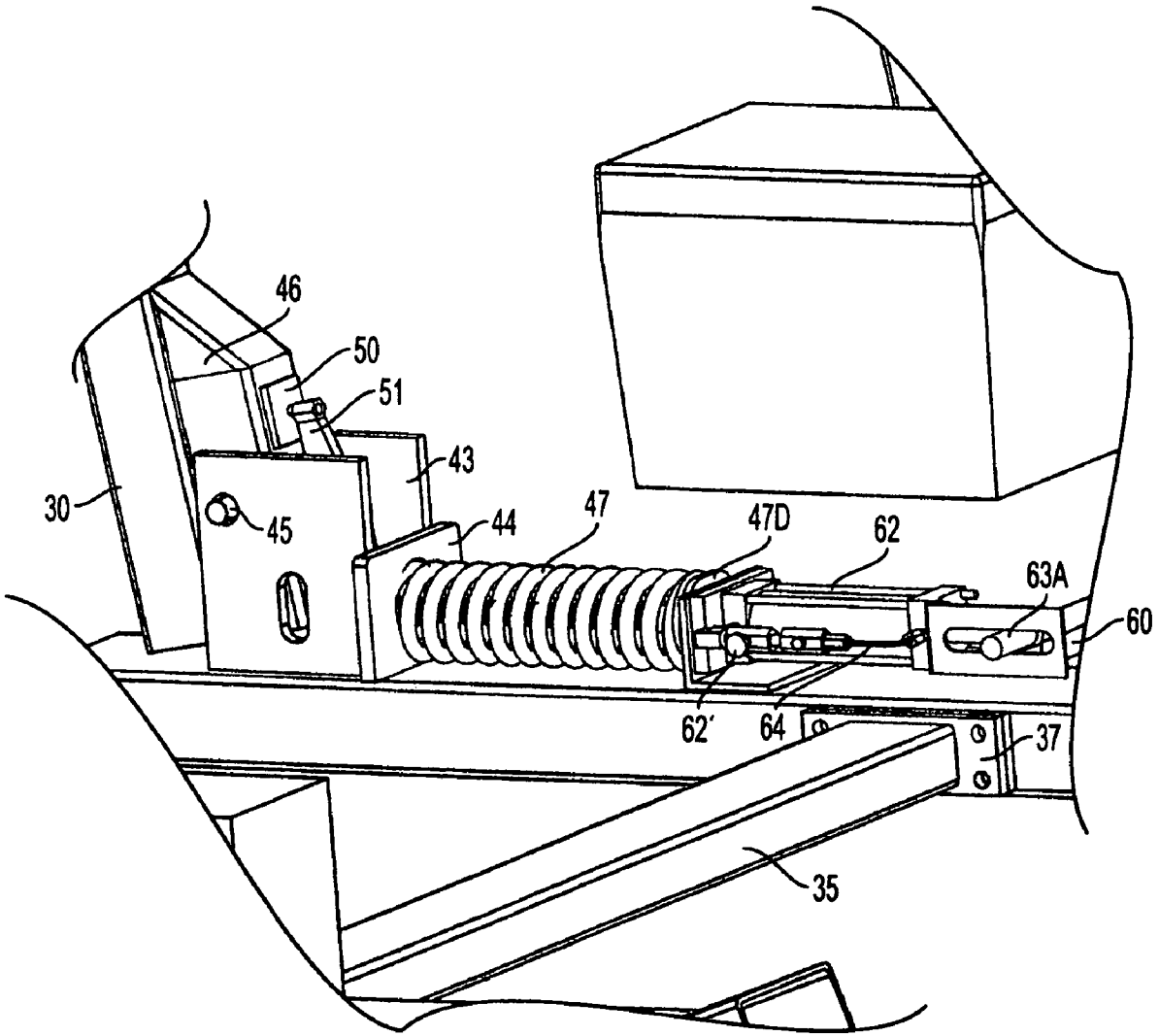
FIG. 7 is an enlarged pictorial side view of the resistance mechanism as shown in the central station in FIG. 1.

A connecting rod 48 is coupled to the lower end of box structure 46 and transfers force to a disc surrounding the rearward end of rod 45. A resistance spring 47 is captured between the back of cross plate 44 and the vertical portion of an angle fitting 49 fixed to the top of base rail 32. Spring 47 acts against (resists) rearward swinging motion of post 40 from its upright position as shown in FIGS. 2, 3 & 6 due to force applied by an athlete/trainee. A force measuring device such as a load cell 50 (described later) is mounted on base rail 32 and is actuated by an arm 51 attached to the forward end of connecting rod 45 and capable of pressing against the device 50 (FIG. 7). Connecting rod 48 is secured to the reciprocating rod of a hydraulic cylinder 62, which is mounted to the backside of angle fitting 49 (see below).

A touch plate or target 55 is supported on upper post section 41A (FIG. 4) which provides a vertically adjustable telescopic support for target 55, so as to locate and hold the target at a desired spacing above pivot mount 42, by the retaining bolt 41R. This adjustment provides a convenient way to accommodate the system to the size of the athlete/trainee. Touch plate 55 includes a forward facing, preferably rectangular, diaphragm or pad 56 to which the touch or 'punch' is applied, causing the post 40 to pivot rearward away from the user/trainee around pivot bolt 45. This pulls rod 45 forward against the force of spring 47 and resistance from hydraulic cylinder 62.

As previously mentioned, the touch pad(s) are designed to make the user(s) focus on a small target area. Focusing on a precise area or areas will help to improve the overall blow/force delivered by the user or trainee, where that measurement is useful.

Figure 4:
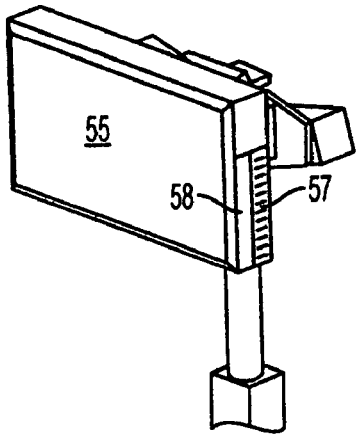
FIG. 4 is a perspective view of the partially telescoped upper and lower sections of the swinging post that provides a height adjustable swinging mounting for the touch plate, and inner components of that target.
Figure 5:
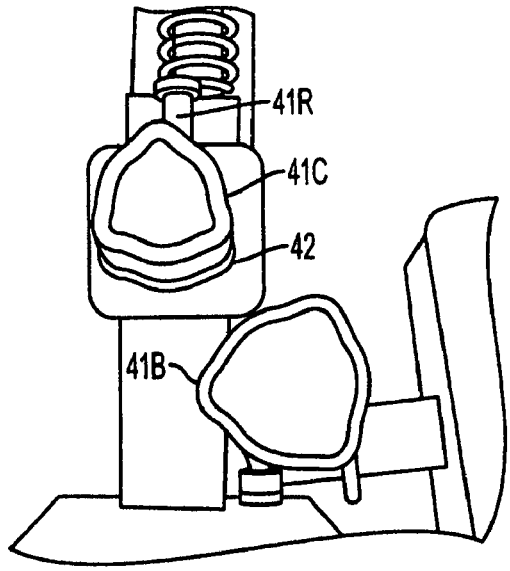
FIG. 5 illustrates side-by-side cross-sections of the outer and inner portions of the post.

In both embodiments, touch plate 55 consists of a square or rectangular center 57 of plywood or equivalent, with a semi-dense compressible pad 58 fastened to one side the plywood. The touch plate pad is wrapped with a heavy-duty vinyl cloth-like cover material 60. The center 57 is predrilled and anchor bolts attached before the padding and vinyl are attached. The completed touch plate is then bolted onto a metal support plate 59 on the upper post section 41A (FIG. 4). All the touch pads preferably are interchangeable. They are designed to be as thin as possible (but thick and resilient enough to protect hands from injury while punching or 'hitting' the pads), so the athletes/trainees are able to grab the backside of the pad (when necessary) with their fingers as they are hitting it with the palms of their hands. The premise for using such a thin pad is to help the athletes/trainees improve their grip and to teach them to grab an opponent (if that is desired and permitted) in a training regimen for a particular sport.

As mentioned above, the end of rod 48 beyond spring 47 (FIGS. 7 and 8) carries a disc 47D attached to the rod, and is attached to the rod part 63 of hydraulic cylinder 62 (part of the force resisting and measuring system) which includes an arm 63A that functions to actuate a magnetic limit switch 60 at its rearward end. When switch 60 opens it creates a stop signal for a timer in the controller (this is part of the first embodiment). The timer is started in response to a 'hike' or start signal, e.g. an initiation of a training program (see discussion below of programmable system controller).

Load cell 50 is located so as to be pressed during the rearward excursion of post 40 as a result of hits applied against the associated touch pad, thereby providing a signal to the controller representative of the force of a 'hit' against the touch pad. Also, a bypass tube 64 connects the cylinder cavities of the hydraulic cylinder 62, and an adjustable valve 62V controls the flow of fluid through tube 64, which in turn regulates the resistance to motion of connecting rod 48 and the attached post 30; this bypass and valve is also a part of the second embodiment of force resistance and measurement.

Figure 7A:
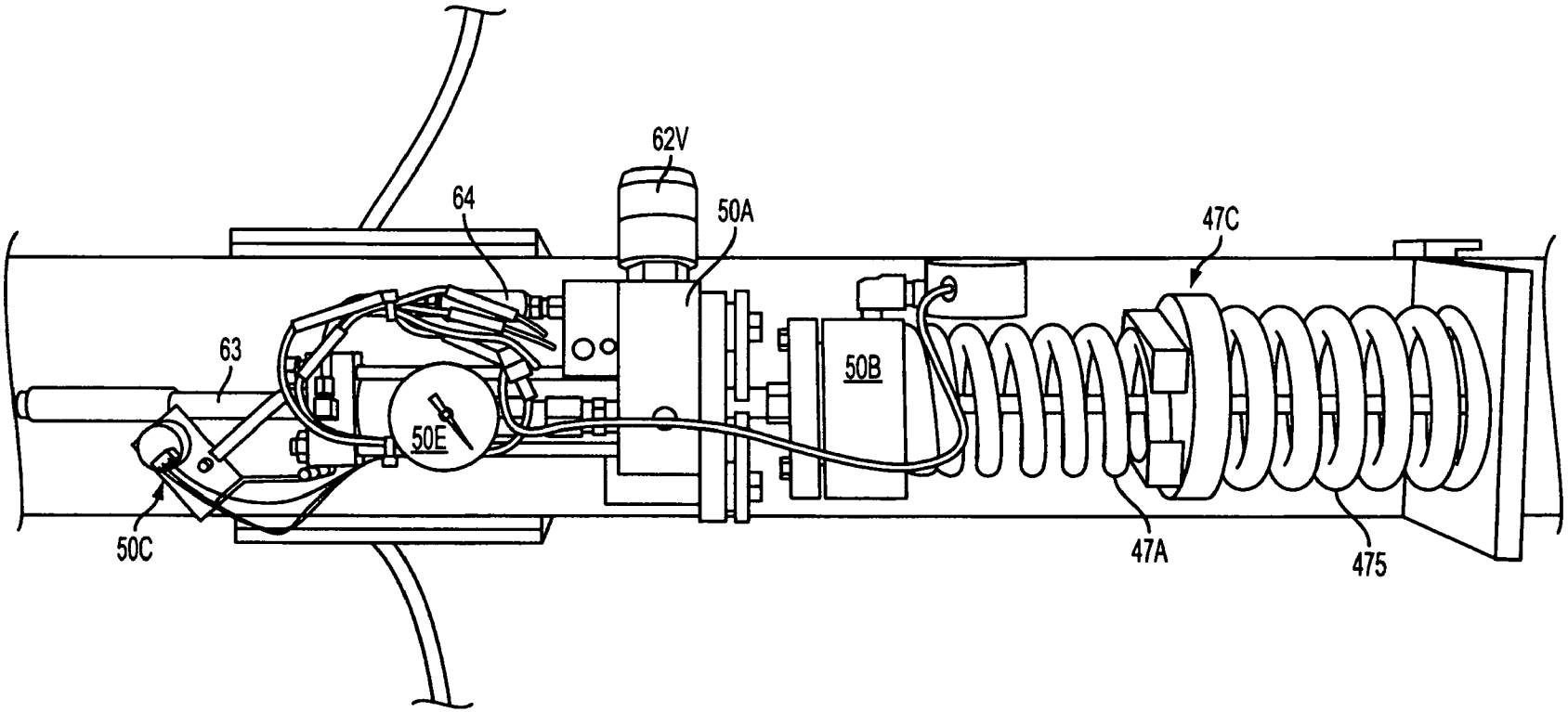
FIGS. 7A, 7B, 7C & 7D are perspective views of some modification features to the resistance mechanism and information feedback device as illustrated in FIGS. 7 and 8.
Figure 7B:
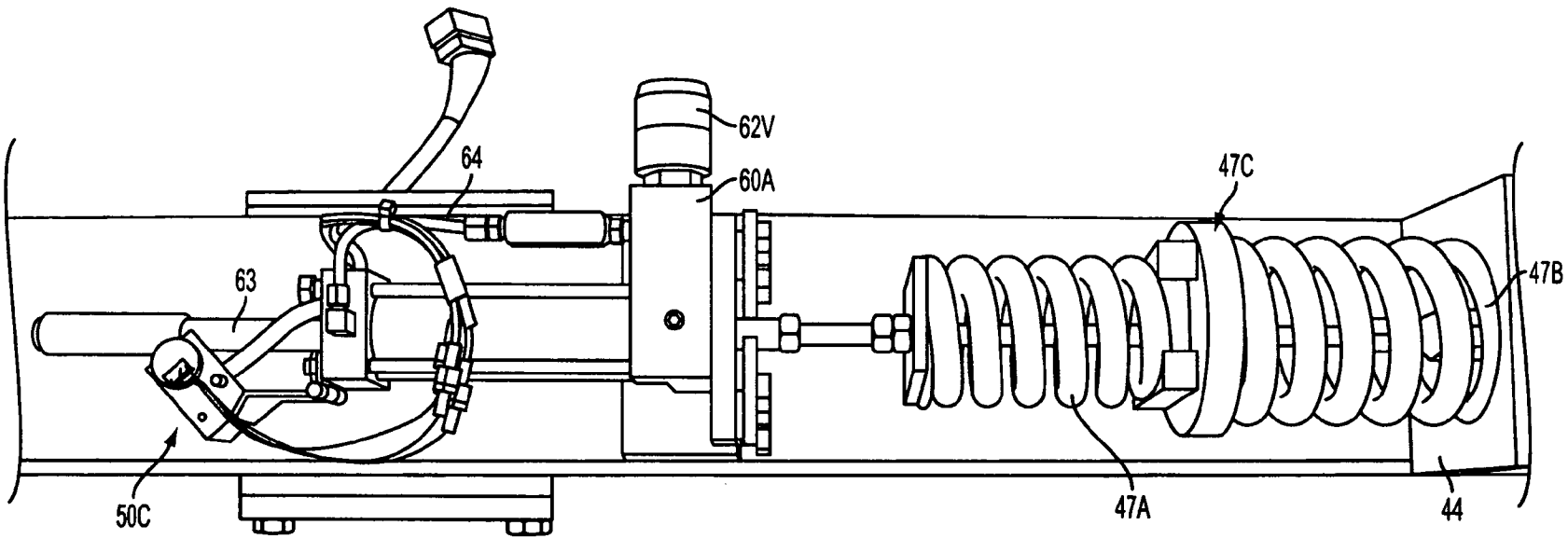
Figure 7C:
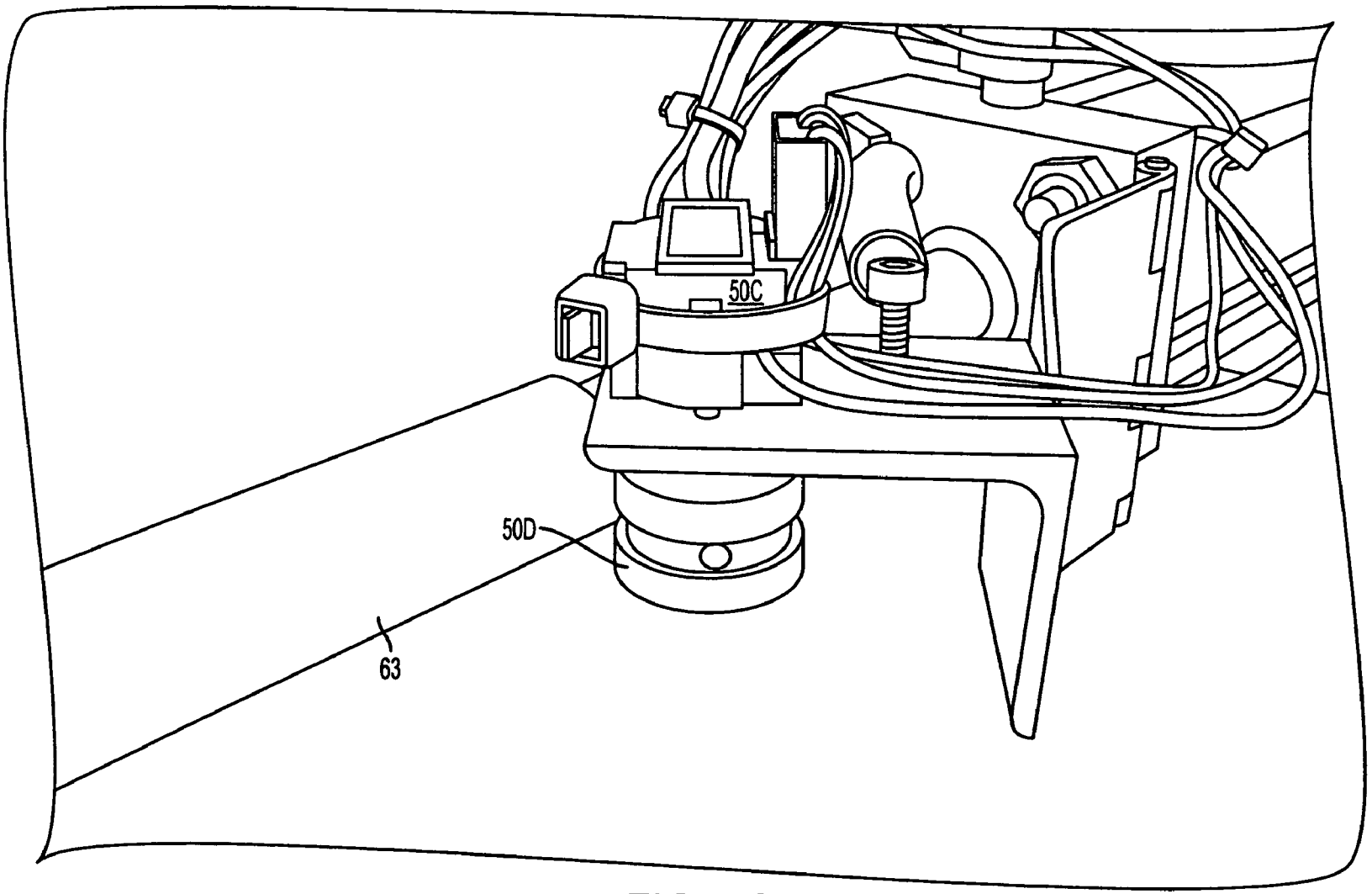

FIGS. 7A, 7B and 7C, illustrate features of the second embodiment of the apparatus which include preferred mechanisms for sensing and utilizing the forces exerted against the touch pad(s) to record and display performance data related to the users, e.g. athletes being tested and/or trained. The most sophisticated of these mechanisms is intended for incorporation in the central station 30 (although it can be fitted to and used in the stations 30A and 30B if desired). FIG. 7A shows a compound spring device comprising first and second springs 47A and 47B that have different sizes, strengths and spring rates. These are paired in serial fashion by an intermediate block 47C that engages and centers the opposing ends of springs 47A and 47B. Thus, the springs and block provide a simple variable-rate spring system in opposition to the motion of the touch pad and its swinging mounting, which motion is imparted to the connecting rod 48A that is mounted between the cross-plate 44 (as in the first embodiment) and the disc 47D. The connecting rod 48A is secured to the rod of hydraulic cylinder 62A.

Figure 8:
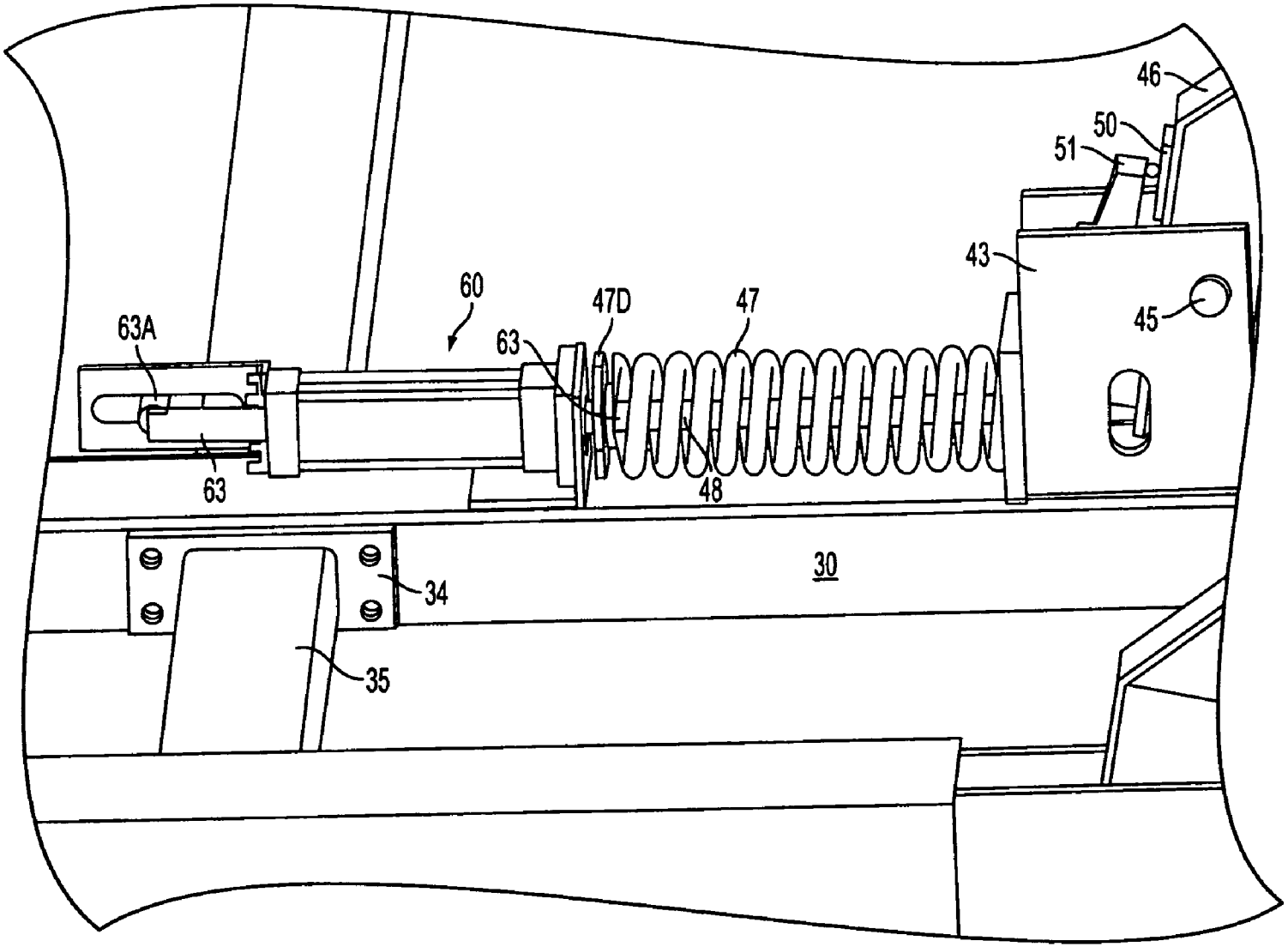
FIG. 8 is an enlarged pictorial view of the other side of the resistance mechanism (first embodiment) shown in FIGS. 1 & 2.

FIG. 7A shows the features of the second (new) embodiment, which includes additions to original FIGS. 7 and 8. FIG. 7A includes the dual springs 47A, 47B and related transducers 50A and 50B which (respectively) will transmit information to the main/central controller 13. Transducer 50A senses the internal pressure in hydraulic cylinder 62A and transmits a corresponding signal to the programmable central controller 13, and a second 'acceleration' transducer (see also FIG. 7C) is provided in the form of a rotary encoder 50C driven by a roller 50D engaging the rod of hydraulic cylinder 62A. Roller 50D drives rotary encoder 50C, which sends a string of pulses to central controller 13 during the motion of the hydraulic cylinder rod against main spring resistance. This provides the central controller with information to calculate the force of the 'hit' against the touch pad, based on acceleration of the pad motion over time due to the spring resistance.

The rotary encoder communicates with the PLC central controller 13 and registers the movement of the cylinder rod 62R, which is connected to the vertically swinging tube (40, 40A, 40B) and the touch pads thereon. The PLC central controller 13 uses rotary encoder 50C to control how far the cylinder rod must move before the PLC central controller recognizes a 'hit' on a touch pad. By using the Sensitivity button on the handheld units (first or second embodiments) the coach can set the PLC central controller 13 to not recognize a 'hit' on a pad until the rotary encoder has moved a selected distance. This distance is set by selecting a number on the handheld from two (2)-ninety (90); (2 corresponds to requiring the least amount of movement and 90 corresponds to requiring the most).

The Rotary Encoder is (if desired) also used to measure the hand speed on each individual station. This is accomplished by measuring how fast the wheel on the rotary encoder accelerates over a specified distance of movement of the cylinder rod. This information is translated by the PLC central controller, and the results are forwarded to the handheld display(s). The hand speed (or the speed in which the pad travels a specified distance) can be measured and recorded in the Force, Reaction and Speed drills. The touch pad speed can be displayed on the handheld controller as a numerical number for each individual station.

The apparatus illustrated in FIG. 7B does not have the roller-driven rotary encoder and 'acceleration' feature, and is used on the other stations (such as 30A and 30B).

Figure 7D:
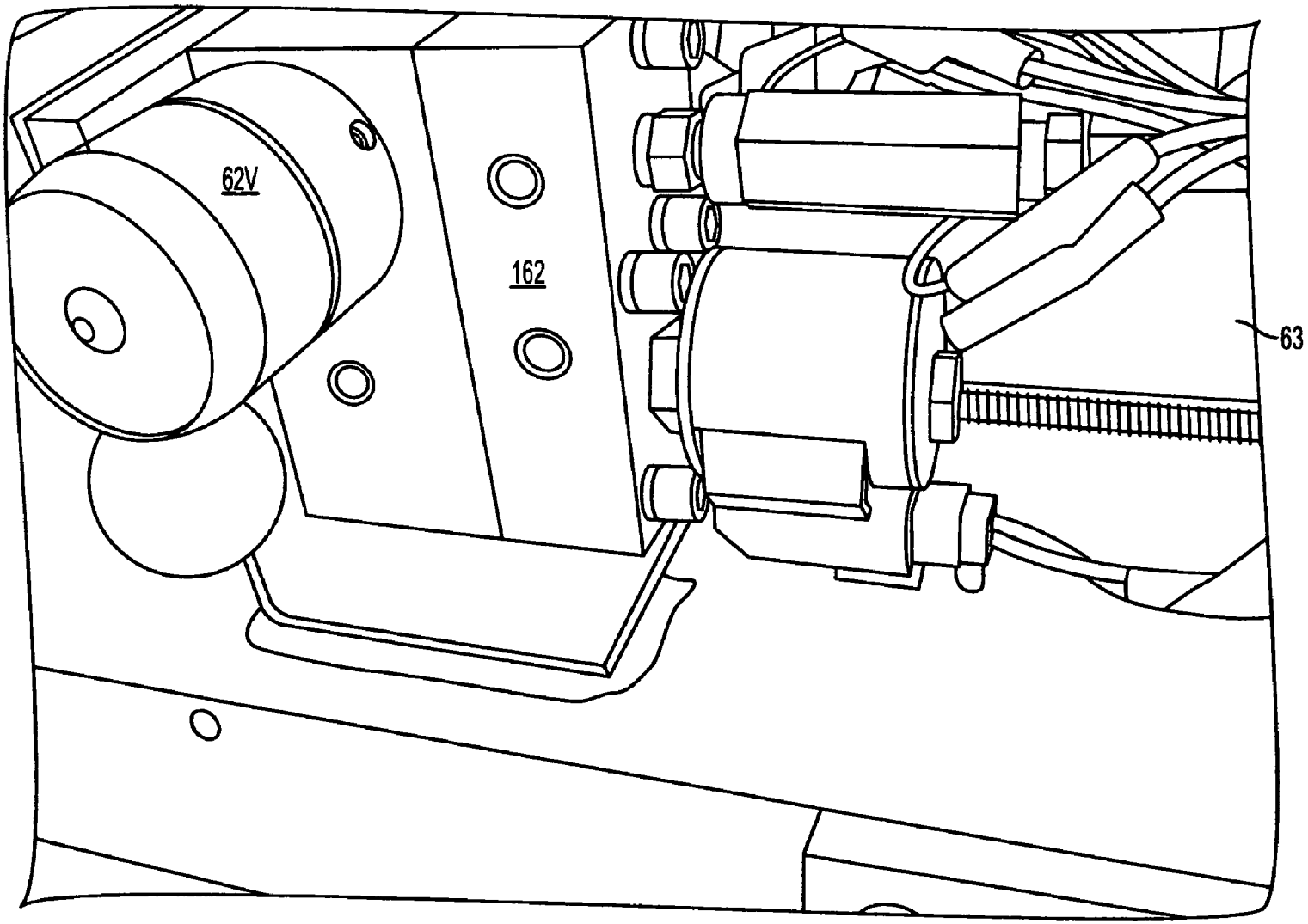

The solenoid-operated valve 162 (FIG. 7D) is connected to establish a separate further by-pass path 9 or fluid circuit0 between the opposite sides of hydraulic cylinders 62, 62A, in order to override flow control valve 62V when testing an athlete in the "FORCE and DATA FORCE" drill. This override circuit disables the variable effect of the flow control valve 62V being set to different positions (openings) during testing; i.e. variable by-pass valve 62V settings would cause the test data to be different and not reliable.

The only variable that must be kept the same during testing in the "FORCE and DATA FORCE" drills is the pad height. The pad height must be in the same position for all tests to be accurate.

Auxiliary Touch Pads

An auxiliary or optional feature, which is used in either the first or second embodiment of the over-all apparatus, incorporates auxiliary touch pads 55A, is illustrated in FIGS. 1, 2, 3 & 6. Tubular sockets 65 are secured to the rear of the mounting for the primary touch pads 55, and angled outrigger arms 66 extend from sockets 65 as shown in FIGS. 1 & 2. The arms include inner and outer sections 67I and 670 connected by hinges 68, and forward extending ends 69 that provide a mount for pads 55A. Pneumatic spring cylinders 68S extend between the respective inner and outer sections, tend to urge pads 55A to an extended position where they are located forward of the primary pad(s) 55 and facing inward and downward with respect to the centerline of the central station. These optional auxiliary pads are intended for sensing touching or striking during more complex training programs, as later described; they are not intended to sense force of such touching. When the auxiliary pads 55A are touched, spring cylinders 68S will allow rearward motion, and then return the pads to a normal position.

Touch Pad Information/Operation

The touch pads are designed for the athlete to focus on proper hand placement for the most efficient and effective blow delivery possible. The pads also are designed to allow an athlete to strike the pad with the palm of their hands and at the same time grab and squeeze the sides of the pad. This feature allows the athlete to develop a strong grip and with multiple repetitions can assist in teaching the technique of controlling an opponent.

Also, the pads are designed to adjust up and down to accommodate multiple techniques. When the pad is at its highest elevation it is very easy to move due to the change (increase) in leverage. To compensate for the change in leverage the flow control valve 62V can be adjusted by its knob (FIGS. 7, 7A & 7B) to increase or decrease the amount of force required to move the pad. The flow control valve 62V is located at the base of each unit 30, 30A, 30B etc., and is connected to control flow through by-pass tube 64 extending between opposite ends of cylinders 62 or 62A. The adjustment knob of valve 62V knob can be adjusted 180° between a full open position (least resistance) and a nearly closed position (most resistance. This adjustment can be made used to adjust the amount of force required to move the touch pad when the pad is in any position.

To lift or lower a pad to a desired height, it is possible to pull out a handle on the backside of the upper tubes 57 while supporting the pad head. The touch pad assembly must be secured in the selected pull-pin hole before letting go of the pad. The pads and their assemblies are heavy and, if left unsupported when the adjustment pin is pulled out, they could easily fall and cause injury. The pads should never be raised or lowered with the reach block pads 55A installed, rather the reach block pads should first be removed.

A Pad Sensitivity button is available in most programs (see below). This function is designed to let the coach or operator control how hard an athlete must hit the pad before a positive touch is recorded by the central PLC controller computer. For example, once a touch is recorded, the athlete will be sent to the next station in the program (by lighting or flashing a lamp on the next station in a selected program) or the reaction time will be displayed. A weak hit may cause the athlete to receive slower times or no time at all. The PLC controller measures the travel of the touch pad in both directions. Therefore, if the athlete does not strike the pad hard enough, he must wait for the pad to travel the selected distance (sensitivity) until the next station is illuminated. To adjust touch the Pad Sensitivity button on the handheld and select a setting from 2 to 90. Touch the return/enter button and the selected sensitivity will be displayed on the drills main screen. (See Program Descriptions below).

Controls for Operating Programs

Figure 13:
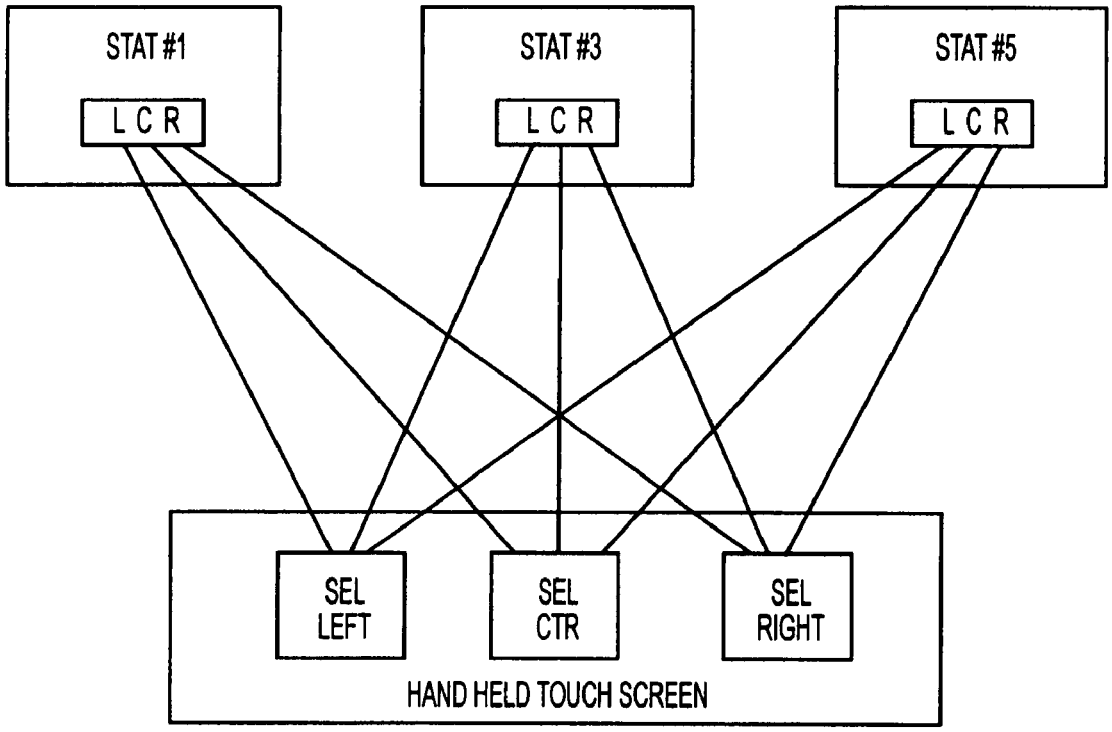
FIG. 13 is a block diagram showing the touch screen device communicating with other stations.

In both embodiments illustrated and described herein, a remotely programmable controller 13 is housed adjacent the central station 30, preferably directly at its side, within a closed console 12. The apparatus may be used in either an indoor or outdoor environment, so it can be subject to a relatively wide range of temperatures. Thus, a suitable cooling fan with automatic heat sensitive control is provided in the console to provide forced ventilation as needed. The controller device 13 used in a working embodiment is a commercially available Toshiba T1-16S programmable controller powered by two 12V rechargeable batteries with a capacity of 7 amp-hours. It is provided with an Xbee Pro radio modem (Manufactured by MaxStream) attached to the controller's RS-232 port, and communicates (at approx 2.4 GHz) with a hand held touch screen remote control device 14 (FIG. 13) fitted with an external ring 14R to which a suitable strap or lanyard can be connected. Thus the touch screen control device can be carried by an active coach/trainer/tester person and provide that person with direct control of the system as he moves about.

The touch screen device 14 in a first working embodiment incorporates a Toshiba OIS50 touch screen unit and Xbee-Pro radio modem; these are powered by an internal 24V rechargeable batter pack. An on-off rocker switch is on the exterior of touch screen device 14. Thus, in normal operation all control functions are accomplished with touch screen device 14, which may be wireless or 'hard wired' via a suitable cable.

Figure 12A:
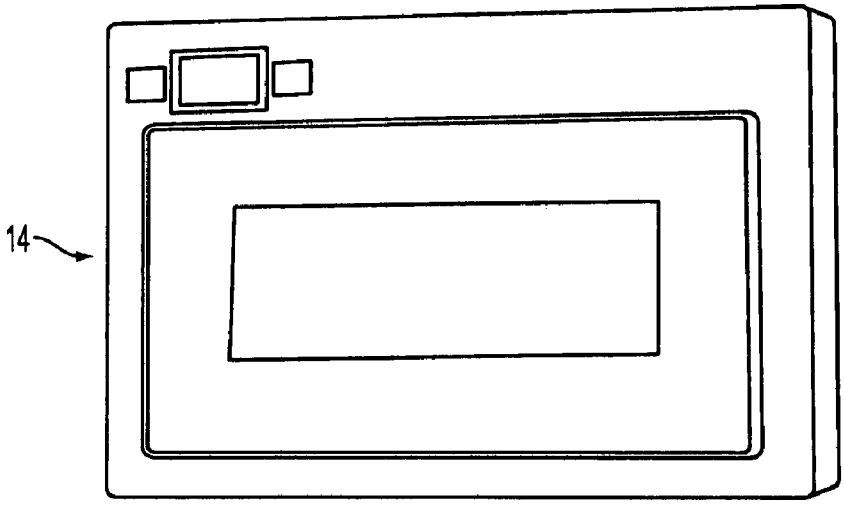
FIG. 12A is a front view of another form of hand held touch screen device which is commercially available, and can be programmed for use as wireless touch screen communication with the central controller computer.

In a second (preferred) embodiment, an HP IPAC 2400 model hand-held personal pocket computer (or equivalent) is employed as a wireless controller (FIG. 12A). It is linked to the controller device/computer 13 using Instant-HMI software available from Software Horizons, Inc. [see www.instanthmi.com and www.horizons.com for details; both are incorporated herein by reference] for details}.

Figure 2A:
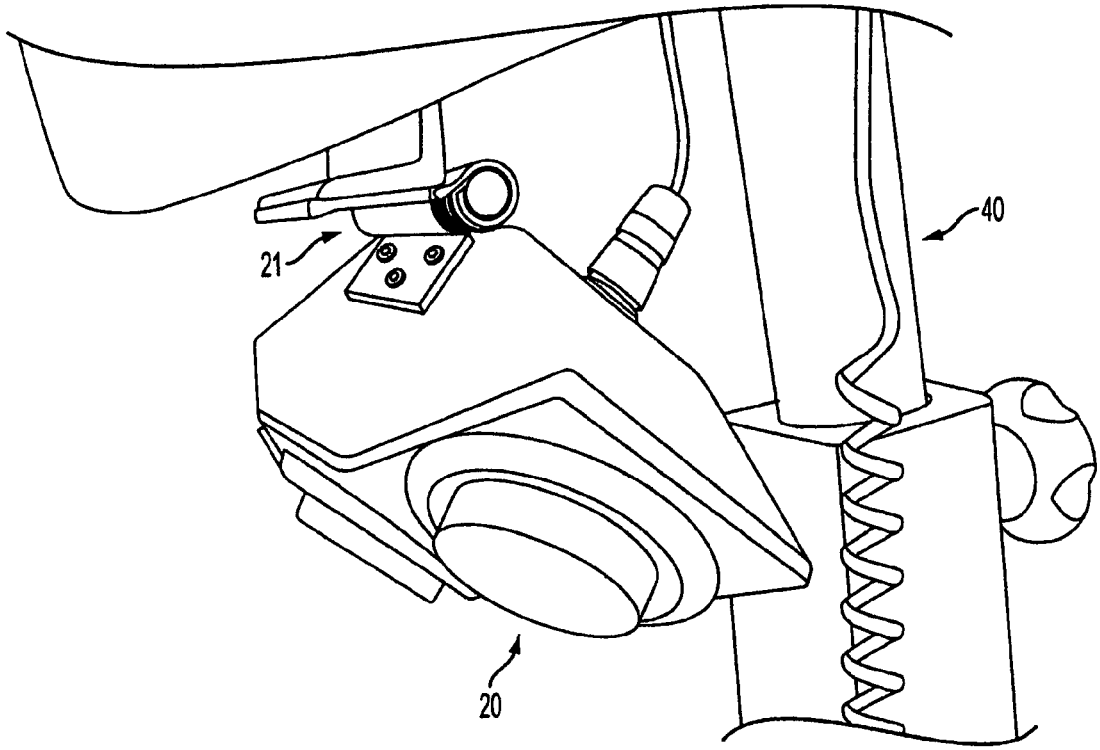
FIG. 2A is a perspective view of a modified form of the stations, using break-away mounts for the signal lamps.

Reverting to FIGS. 1-3, indicator lights 20, which can optionally be of appropriate colors, are fitted to the post sections 41B to signal the start (and stop if desired) of a specific reaction, or the outcome from a multi-user situation. These multi-light units are referred to as "light trees." A modified form of light tree (shown in FIG. 2A) is mounted to the underside of the targets 55 with a spring type mount 21, allowing the lights to move away if they are accidentally struck during use.

The touch screen remote control device has a display pad (FIG. 13) for initiating and monitoring individual or group testing routines as described herein. Touch buttons (see FIGS. 16A-K) on the control panel for each individual station can be pushed to flash appropriate ones of the light trees on the control arms and thus provide a stimulus signal for initiating agility and/or punching and blocking drills, enabling the user to move up and down the row of stations following the illuminated lights. This type of action(s) is quite useful to test, train and/or develop lateral movement, peripheral vision and hand punch.

The apparatus provided by the invention is capable of recalling program routines stored in its controller memory, and allowing a trainee to use the routines without a trainer/coach supervising; also the same programs can be followed under tutelage of a trainer/coach. The basic single station "sled" apparatus can even be used without a controller, simply sequencing operations of start/stimulation, time reaction measurement, and illumination of signal lights.

In a single use situation, a ball 20 (FIG. 9) attached to a ball-snapping lever 22 can stimulate the controller 11 to start its internal timer 13 and energize one or more lights on the light tree of the station in use. When the single user makes contact with pad 55 the timer will stop and display the results on an appropriate one of the digital readout displays 15, which are part of the touch screen device 14. Another portion (or window) of the touch screen digital display will also show a numerical reading of how hard the user or trainee was able to hit the pad (force or impetus).

Thus the lamps of the light tree on the sled arm(s) 30. 30A, 30B etc.) may also be used by the trainer/coach to trigger the start of a specific reaction. This reaction will then be terminated when the pad is hit, and the elapsed time of this reaction will also be displayed on the hand-held touch screen device 14. This action will also show the amount of time it has taken for the user to recognize that a light has turned on (or a snap has occurred) and in-turn a 'hit' to the pad has been sensed.

With multi-stations, multiple users can be tested at one time. The activation of the ball snapping device, or a selected one of the lights, will start the timer. The users will react and then strike their respective pad. The fastest user will be shown flashing lights on the light tree on the pad arm in front of him. In turn the user with the slowest reaction time will receive a solid light signal on the respective pad arm before him. The coach or operator will be able to read each individual reaction time on the touch screen device 14. The display also ranks the athlete according to the reaction times.

The force from the hits of all users may also be displayed on the hand-held device 14 if desired. In a multi-station use the coach/trainer operator is also be able to light each pad station independently for individual reaction and force readings, if so desired.

This multi station apparatus is also capable of being used for agility training. The users can move laterally up and down the line of pads punching them in succession or in a pattern as illuminated by the operator (lights on each pad arm can be illuminated as the operator sees fit.) This action will promote foot agility, balance, hand punch, and peripheral vision. The pads, and auxiliary pads, can also be vertically adjusted and tilted to simulate multiple punch zones.

This apparatus can be used indoors or outdoors. It includes a self-sufficient power source, which may be recharged as required after a substantial period of use. No head gear is needed, but may be used optionally if it is desired to accustom the athlete (or tested person) to wearing it under certain conditions. Since this apparatus does not need to be moved around for proper use. It can be set in a stationary position outdoors or in a weight room or other facility, and thus utilized year round.

As noted above, batteries can provide internal power to power the controller; no external power connection is needed. A charge for those should last a full day of normal use. Batteries are normally charged by activating a self-contained charger (not shown) while power is off. A full charge is developed overnight. A suitable light on the charger indicates charging in process; and 'charging complete.'

As previously mentioned, the touch screen device 14 in the first embodiment is preferably a wireless-linked remote device, but it could have a connection to the control box through an extended flexible multi-strand cable and be powered by a custom battery pack.

Timer/Apparatus Features

As previously described, the resistance to a trainee/player's hit on a pad is developed by spring(s) that provide an increasing resistance as the pad is moved rearward. There is also a hydraulic mechanism that provides additional resistance as the player increases the speed at which he moves the pad forward. This hydraulic mechanism is adjustable to compensate for the change in leverage created when the punch pad is raised. The controller can be programmed so as not to register a 'hit' unless the pad is displaced at least two inches. Pad height is adjustable in 3-inch increments up to 60 inches.

All information that is recorded by the PLC can be uploaded into a computer. This data can be configured in many different ways and will be a valuable tool for the coach/trainer in evaluating an athlete's (or group of athletes) performance.

Remote or Satellite Station(s)

Figure 10B:
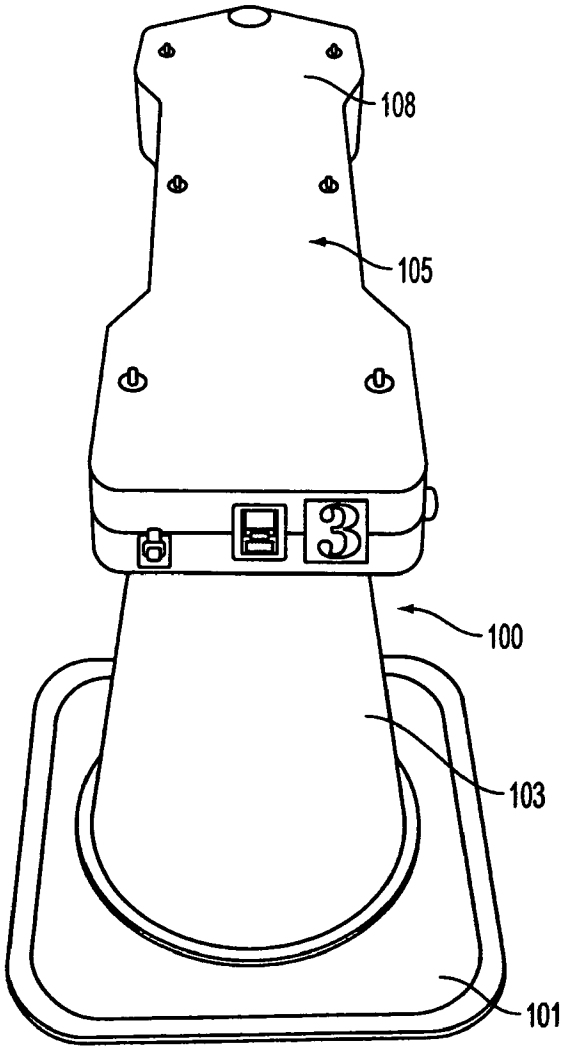
FIGS. 10A and 10B illustrate side and rear views of a form of portable remote station, which can be used as an optional feature of the invention.
Figure 10A:
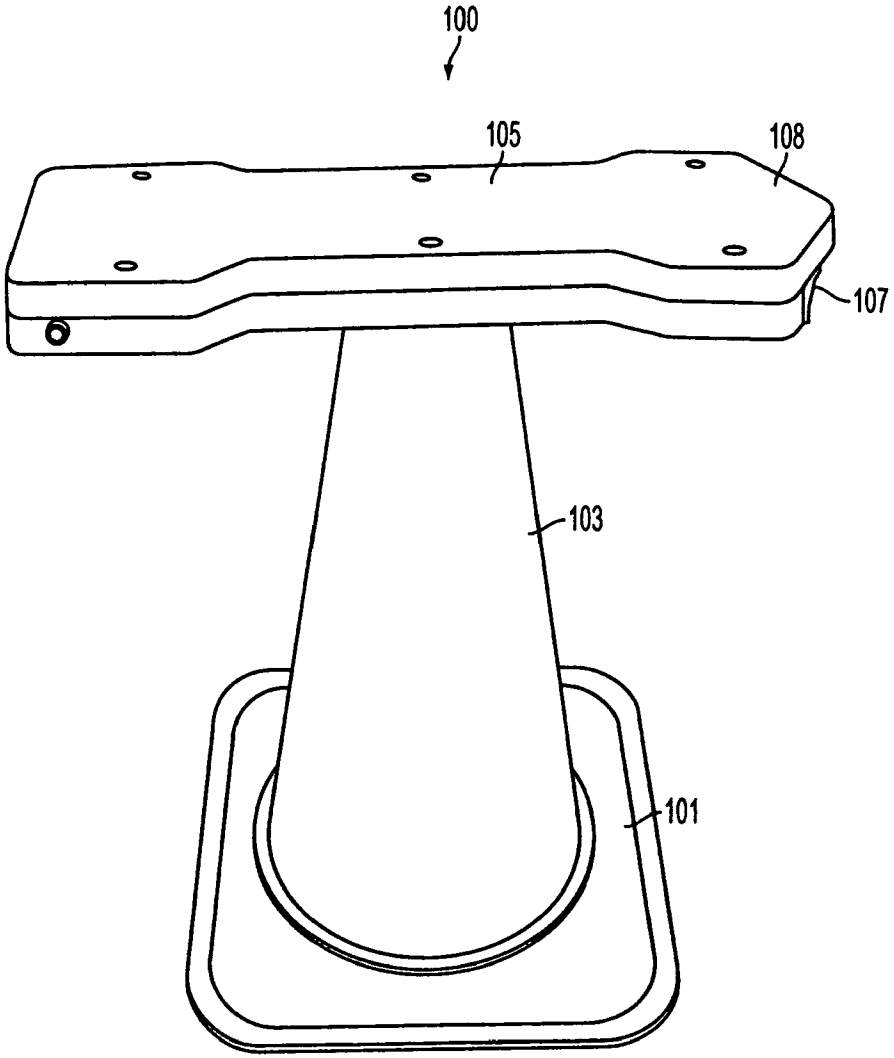
Figure 11A:
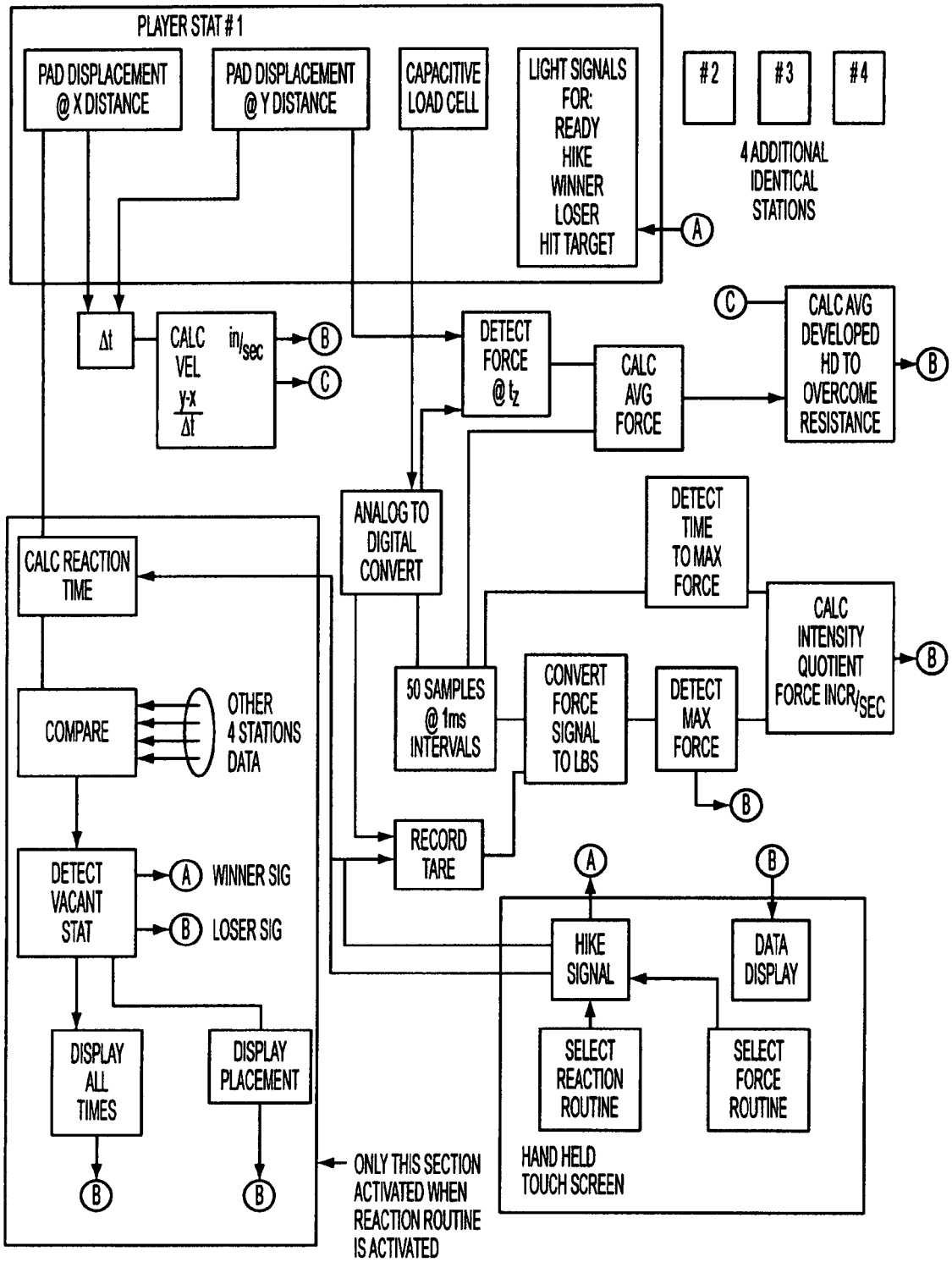
FIGS. 11A & 11B are block diagrams of a control system for a system including five stations, a central station and two additional stations on each side of the central station.
Figure 11B:
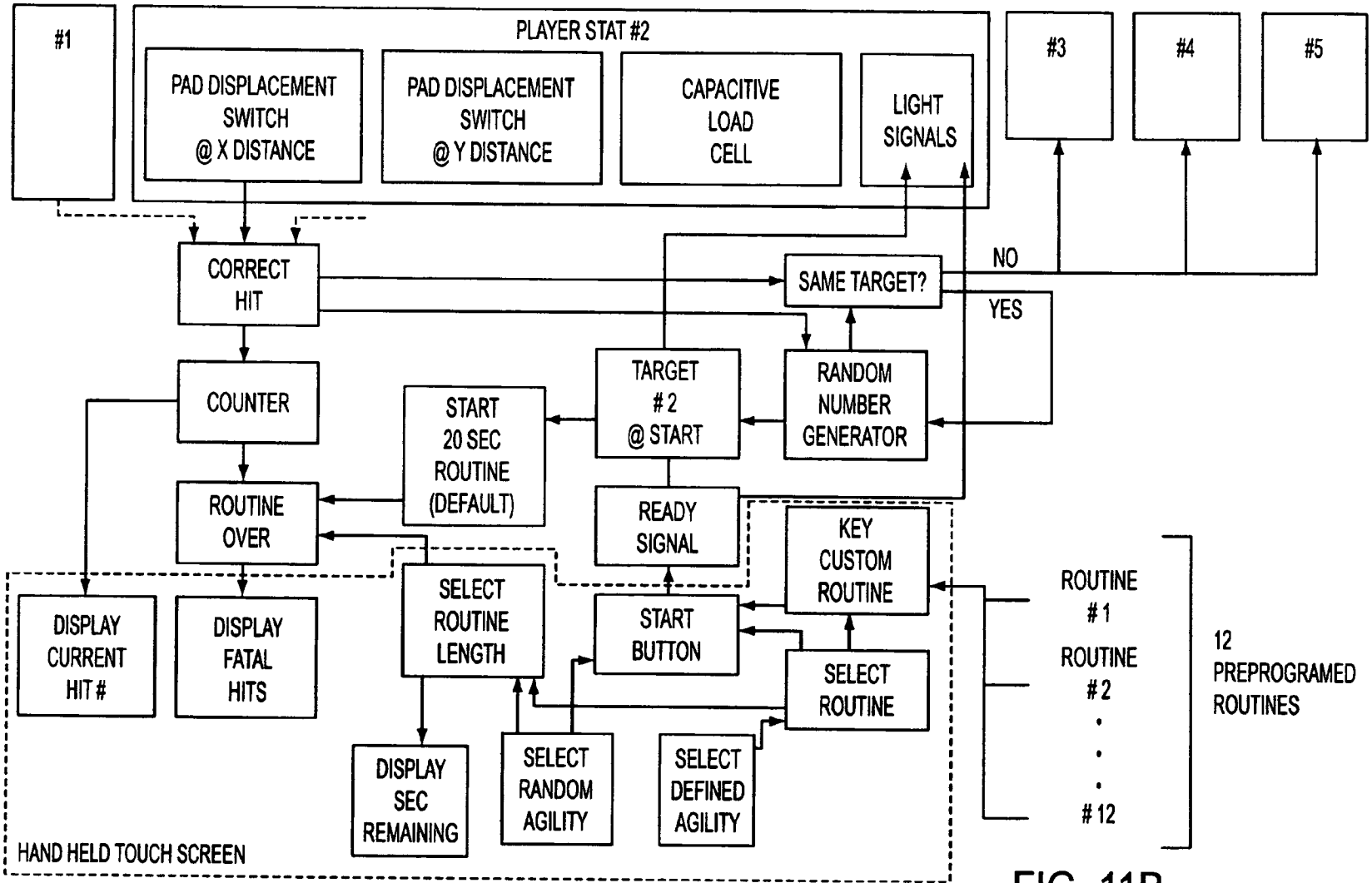

In addition to the Sled unit itself, and the many features incorporated in it, the invention provides one or more satellite stations which are optional, but quite useful in the performing of a number of drills and exercises or tests. This contributes to the versatility of the invention, mostly by expanding the physical area over which the various drills can be performed. FIGS. 10A, 10B and 10C illustrate the features of such a satellite device. In a basic and simple embodiment of such satellite stations, they can be simply passive stand-alone portable traffic cones (or portable flags) which are placed to defined a location or locations away from the principal apparatus (sled), to which the athlete/trainee or candidate must run while executing a particular drill.

FIGS. 10 A, 10B, and 10C illustrate a more elaborate (and preferred) form of interactive satellite station 100 comprising a base plate 101 with an upstanding post 103 (preferably hollow) surmounted by an arrow-shaped top 105 which has a window opening 107 beneath to point end 108 of top 105. The post, in addition to establishing a medium height (about 24 inches in height) provides a housing for a self contained and powered proximity detector apparatus (for example using a photo-sensor or equivalent proximity sensor) and a conventional wireless transmitter-receiver set up to function with the PLY central controller and its handheld unit and register the 'presence' of the athlete-trainee to the post in executing the prescribed route or routes of different programs. A controlled audible sounder (beep) is included to provide an audible signal that the satellite unit is a functional part of a program being used; a flashing signal/lamp can also be used. One the athlete runs to the active satellite unit and his presence is detected, a signal is transmitted to the PLC central controller, which then causes the next location in the program to be indicated.

Testing/Training System Operation

Figure 12B:
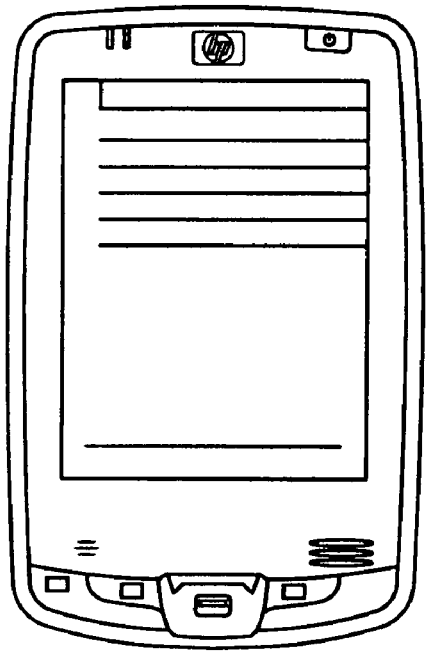
FIG. 12 (sheet 2) is a font view of a programmable hand held touch screen device to be used by a coach/trainer for communicating with the control system.

Power to the control box can be turned on with a suitable switch. An amber light on cover 12 indicates power is on. The touch screen device 14 is turned on with the rocker switch next to the screen (FIG. 12). The screen will light up and, after establishing wireless communication with the controller, display the Home screen (FIG. 16A).

One of several buttons, Agility, Reaction, Reach Block, Speed, or Force is selected with a touch of the appropriate screen area (FIG. 16A).

The Set Agility screen (FIG. 16D) has three selections, Random, Defined or Agility test. The Home button returns to the Home screen.

Training/Testing Utilization & Methods

A variety of programs can be stored in memory in the controller device, and are made available for supervising and controlling various routines or 'drills' to which the user/trainees can be subjected. Following are descriptions of a number of such programs. Custom programs can be added by appropriate programming of the controller. FIGS. 16A-16K illustrate the displays associated with each of a variety of programs

Random Agility

In this routine the coach/trainer selects the length of time for the drill from 15 to 45 seconds in increments of 5 seconds. Pushing the Start Drill button starts the left and right lights flashing at each station for 3 seconds as an alert signal. The center (red) light at one station then signals the user/player to hit that pad. Immediately the computer randomly selects and indicates the next pad, and the player/trainee must touch or hit it. This continues, with the trainee quickly moving to the next indicated pads, until the program time expires. The touch screen then displays the total 'hits' (or touches). If a player hits an incorrect pad, a hit will not register and the program will not progress until the correct pad is hit. The screen also displays the cumulative hit count and time remaining in the drill. Tapping the Back button returns to the Agility Select screen.

Defined Agility

In this routine the coach/trainer selects one of a number of pre-programmed drills. He also selects the length of the drill, from 15 to 45 seconds. The start switch initiates the drill as in Random Agility. Also, the displayed information is the same.

Agility Test

In this routine the coach selects one of the pre-programmed drills, identical to those in Defined Agility (FIG. 16H). He then selects the number of hits that he wants to time. Pushing the number button under Selected Hit brings up a key board (FIG. 16K. The coach keys in the number of hits (up to 99) and taps Enter. The Start button can then initiate the drill and the number of remaining hits is displayed on the screen. When the last pad is hit, the completion time is displayed.

These agility drills are designed to increase a player's lateral movement (foot speed) and peripheral awareness along with a targeted hand punch or touch. Typically, there are twelve or more defined drills available. Some are designed for rapid direction change others are designed to focus on peripheral awareness and others are designed to condition an athlete.

Remote Station(s) Agility

Figure 14:
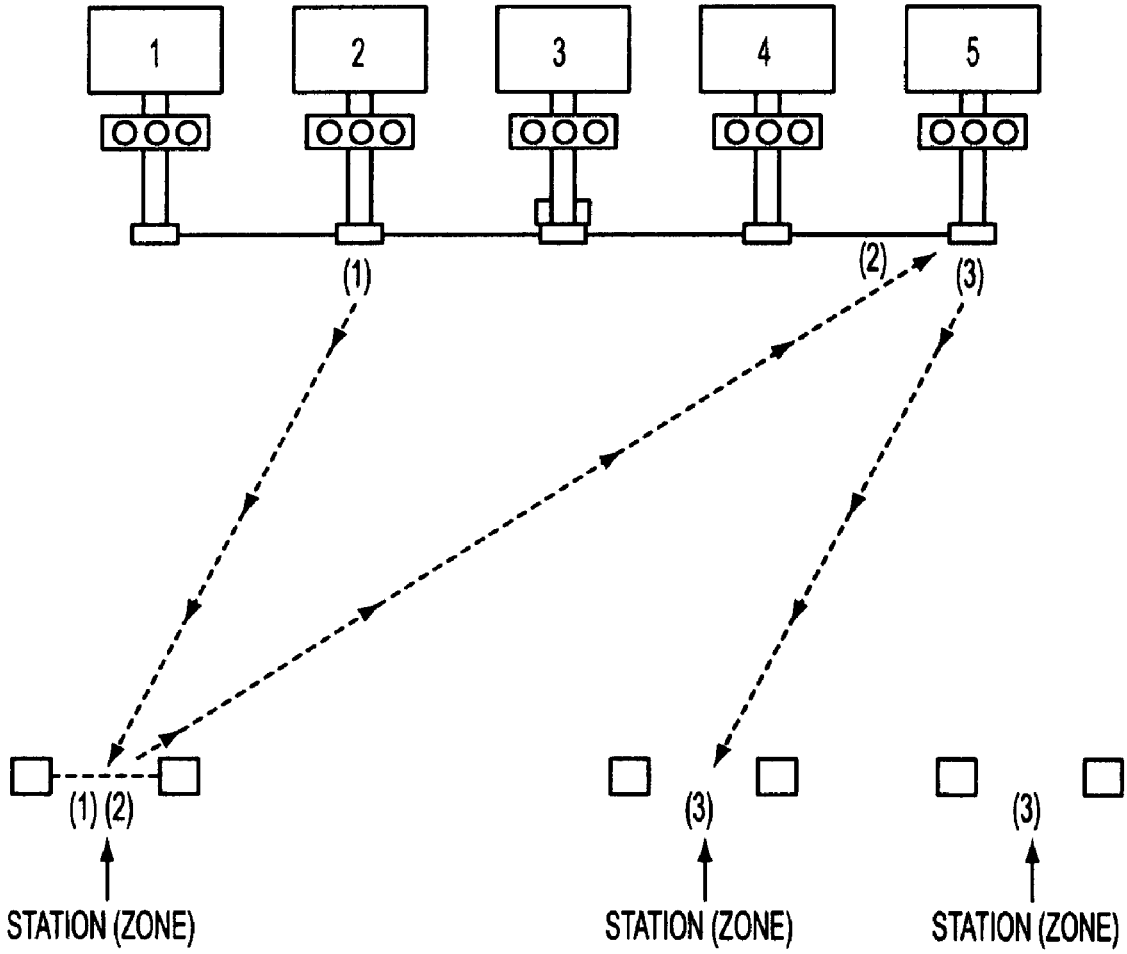
FIGS. 14 and 15 are diagrammatic views of the apparatus utilizing optional portable stations, remote from an array of stations such as seen in FIGS. 1 and 2, and which communicate with the control system and touch screen device, preferably via wireless.

This agility drill using one or more satellite stations 80 (FIG. 10) uses the same predetermined workouts as all the other agility drills. Other drills can be added to maximize its potential. A Drop Zone program (see FIG. 14) allows the coach/trainer to select which station on the sled the player goes to after each trip to a satellite station. Each satellite station includes a sensor (such as a touch pad or preferably a photoelectric "presence" or proximity sensor; see legends on FIG. 10).

The drill (see FIG. 14) starts at the number two station just as it does in the standard agility drills. Once the first pad is hit the athlete must now run to the satellite station. The satellite station can be placed anywhere around the sled/trainer. The satellite station will detect the athlete by either an electric eye (photo sensor), a proximity sensor, or a touch pad. The athlete's foot or leg must break the beam on the photo-sensor or proximity sensor, or their foot must press down on the touch pad. Once the satellite station detects the athlete's presence, it signals the PLC to light the next pad to be hit/touched in the selected workout for the athlete to hit. This process continues until the program has been completed.

Multiple satellite stations can also be used. The athlete would be required to trip/trigger more than one satellite station before the PLC will illuminate the next pad to hit. The athlete is basically required to go in a circle through the stations. e.g. the athlete hits the pad runs to the first satellite station then to the next satellite station then back to the main apparatus. This is different than the drop zone drill. In the drop zone drill the athlete is just required to run to the station indicated by the light tree and back to the main apparatus. This multiple station configuration could require an athlete to cover even more ground and allow the coach/trainer to have the athlete use multiple running/training techniques during a single workout. These techniques could include but would not be limited to a shuffle, backpedal, crossover run, leaping, bear crawl, sprinting, and so on.

Drop Zone (Remote Station Agility Drill)

This drill is similar to the remote station drill. The drill (FIG. 13) starts the same as all the other agility drills. Once the drill is started and the first pad is hit the light trees light one of their three lights. The left light would indicate that the athlete is to run to the far left remote station placed behind them. If the right light illuminates then the athlete is to run to the remote station that is at the farthest right location. If the middle light is illuminated the athlete is to run to the middle remote station. Once the player reaches the station he/she must actuate the photosensor or proximity sensor, which will signal to the PLC to illuminate the next pad to touch or hit. The athlete now must run to the pad that is illuminated punch it and then look at any of the light trees to see which light has been illuminated. Once they recognize which light is illuminated they now know which remote station to run to next. This process continues until the drill is completed. The coach/trainer also has the option to manually operate the drop zone drill by using the LCD touch screen. The touch screen interactive menu would allow the coach/trainer the option to select (use) one, two, or all three drop zones in any particular drill.

An audible device can be added to the satellite station to signal to the athletes that they have reached/triggered the station and that the PLC has activated the next light on the sled/trainer.

These portable satellite stations add another dimension to the agility workout. The satellite station forces the athlete to cover more ground throughout the workout. Depending on the placement of the Satellite station it can make the athlete accelerate forwards, backwards, or at an angle. This workout can measure an athlete over a variety of distances, angles and would be a great tool for a coach/trainer to compare and train athletes in sports where these skills are required.

These satellite stations will allow the coach/trainer to evaluate many different types of athletes over many different distances. Software could be developed that would allow a coach/trainer to log all their athletes times in all the different drills and also record reaction times and force readings. We can develop software to display a player's performance compared to a set standard (to be determined) or against other teammates from day to day, week to week or year to year. An athletes fatigue could even be tracked and displayed through specific workouts. This could be used as a great training and evaluating tool.

Optionally, the drop zone drill can also be used without the Satellite Stations. During standard operation using the Satellite Stations with the photo cell (or proximity sensor) the directional lights on the training apparatus stay on until the beam is broken at the Satellite Station. Once that occurs, the next pad to be hit in the program will then light (or flash). To use the 'no sensor' option the coach/trainer can turn of the satellite station function on the handheld controller, and turn on a timer in the Controller 13, which turns the drop zone directional lights off in a specified time. Then, once the directional drop zone lights turn off, the next pad to be hit now illuminates and the athlete can progress through the drill. Traffic cones or the like could be placed in positions identical to where the satellite stations would be placed. Such traffic cones would represent the area the athlete should run to before advancing to the next pad to be hit in the drill sequence.

Reaction

Figure 9:
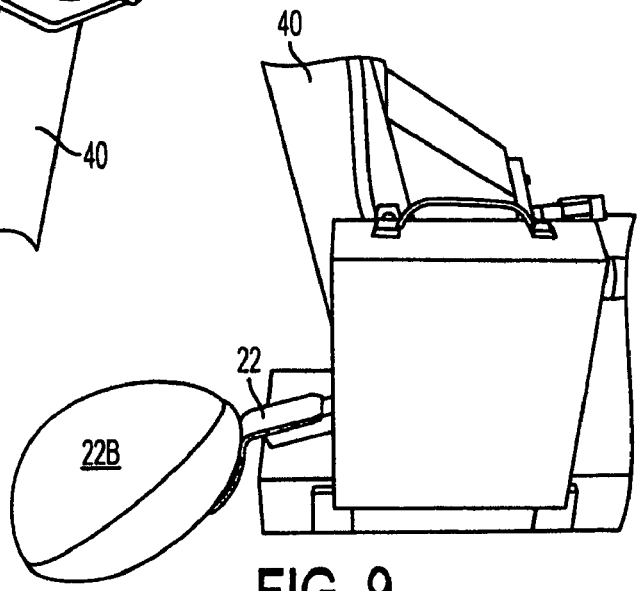
FIG. 9 illustrates a mounted ball and associated mechanism for generating a stimulus signal.

This drill measures the reaction time of players. The athlete initial stimulus is the "hike signal" which can be either a light at each station that turns on or movement of the ball at the center station, or both, (FIG. 9).

The default selection is lights only as indicated by the dark Lite button (on the LCD touch screen display). Pressing the Ball button adds the ball feature. Pushing either button again toggles that feature off. At least one of the buttons must be on to provide a "hike signal". The coach/trainer pushes the Start All button to start the drill when more than one player is being tested.

The first athlete to hit his pad will be signaled by flashing lights at his station. The last athlete to hit his pad will be signaled by a solid red light at his pad. The reaction times of each athlete are displayed on the touch screen along with their placement in the group. The computer detects unmanned stations and excludes them from timing and placement displays. If only a single athlete is to be tested, the coach pushes the black button (on the touch screen) that indicates the selected athletes sled station. By touching the button the coach/trainer activates the "hike signal" and starts the timer.

Once the single athlete hits the pad his reaction time is registered on the LCD display. There is no winner/loser light display in the single athlete mode.

This drill has been specifically designed to develop hand speed, strength of punch. Along with keeping a flat back and developing the athlete's proper footwork and hip pop. The pads have been designed for the athlete to correctly train their hands for proper hand placement and to develop the best possible blow delivery.

Blow Delivery/Reach Block

This drill is designed to simulate a reach or cut-off block. In this drill program, it is necessary to add the auxiliary target pads 55A. The Coach selects Reach Block from the touch screen menu. Three buttons are displayed. Each button correlates to the lights on the light trees of each sled station. The coach can push any of the three buttons at any time. These buttons represent which direction the opposing player is moving, e.g. Reach Left, Reach Right, and Drive Block. The left light of a light tree 20 is selected and illuminates. The athlete(s) must hit the left pad 55A. If the center light illuminates, the athlete(s) must hit the center pad (drive block) 55 (FIG. 4), if the right light illuminates the athlete(s) must hit the right pad 55A). Depending on the number of individual stations on the sled, up to three stations may used at one time.

This drill is designed to train the player to react quickly to lateral stimulus and to use proper hand placement and footwork in a reach/cutoff situation. This drill will makes it easy for a coach to isolate the proper hand punch and footwork that is needed to successfully defeat this type of blocking. Reaction time and placement can be displayed on the touch screen LCD. The hike (stimulus) can also be selected (Light or Light and Ball)

Force

This routine can be conducted at any station that is equipped with a load cell. For testing the pad height must be consistent with all other tests. Besides measuring reaction time as in the Reaction Drill, it also measures intensity, maximum force, horsepower developed and velocity. Intensity is a measure of how much resistance in pounds that the player is able to overcome in the first 150 milliseconds of the hit. The value displayed is in pounds per hundredth of a second.

The maximum force is the maximum resistance that he overcomes any time during the hit. The number displayed is in pounds. The power reading represents a multiple of the average force overcome in nine inches of pad travel times the velocity of the pad during these 9 inches. The number displayed is in horsepower. The velocity display is in inches/sec.

Having a way to measure and log an athlete's hand punch (speed and power) is what this drill is designed for. Hand punch and speed along with the total force applied is a great way to evaluate any athlete. This drill allows a coach/trainer to do just that. All the information that is generated by the load cell can be up-loaded to a computer and then logged in may different forms to evaluate a single athlete or a group of athletes. The hand held touch screen also displays all the information generated by the athlete (load cell) and is able to viewed until the drill is started again.

All testing information resulting from performance of the many available drills can be uploaded and stored in the memory of a typical laptop computer linked to the controller apparatus, and can be copied as desired for distributing results to interested non-local parties.

Program Examples (Agility Drills)

First Embodiment

These programs are written so that the far left pad on a five man sled is one, then two, and so on e.g. 1-2-3-4-5.

Program ONE:—2-4-2-4-2-4-2-4-2 until time expires;

Program TWO:—2-3 and repeat until time expires;

Program THREE:—2-3-4-3-2-4-2-4-3-2-3-2-4-2-4 and repeat until time expires;

Program FOUR:—2-3-2-4-3-4 and repeat pattern;

Program FIVE:—2-4-2-3-2-4-3-4-3-4-3-2 and repeat;

Program SIX:—2-3-4-3-4-3-2-3-2-3-2-4-3-4-2-4-23-2-3-2-3-4-3-2-3-2-3-4-2-4-2-4-3-2-3-4-3-4-3-4-2-3-2-3-4 and repeat sequence if time allows.

Program SEVEN:—2-5-1-5-1-5-1-5 and so on;

Program EIGHT:—2-3-5-3-1-3-5-3-1-3-5-3-1-3-5-3-1-3-5-3-1 and so on;

Program NINE:—2-3-4-5-4-3-2-1-2-3-4-5-4-3-2-1-2-3-4-5-4-3-2-1 and so on;

Program TEN:—2-5-3-5-4-5-3-5-2-5-1-5-2-5-3-5-4-5-3-5-2-5-1-5-2-5-3-5-4-5-3-5-2-5-1-5, and so on;

Program ELEVEN:—2-3-5-1-2-4-2-1-3-5-3-4-2-1-4-5-2-3-1 and repeat;

Program TWELVE:—2-4-1-3-5-2-1-4-3-5-1-2-4-2-3-1-4-5-4-1-5-3-4-2-3-5-3-2-1 and repeat.

The first three workouts and programs 7-9 are designed for speed, and there is no change of direction until the player gets to the end of the sled or as wide as the program goes (not much thinking, just speed). Programs 3-6 and 10-12 are designed to make the player look and find the pad that is live.

Screen Views for Wireless Hand Held Controller

Figure 17A:
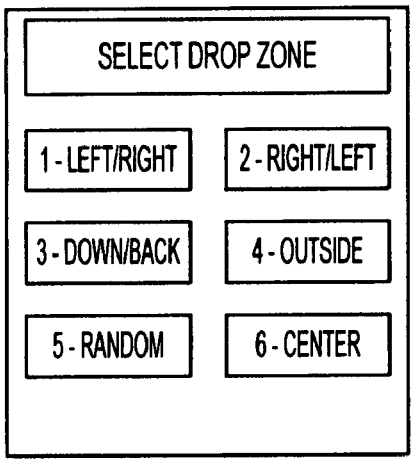
FIGS. 17A-17DD are another set of images representing display screen information which appears on the wireless handheld unit shown in FIG. 12A.
Figure 17B:
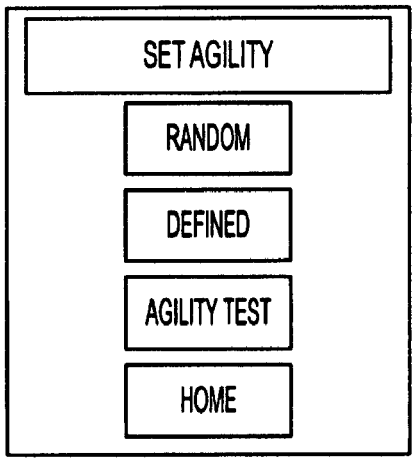
Figure 17C:
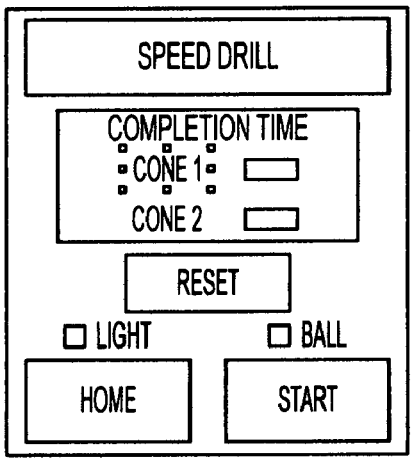
Figure 17D:
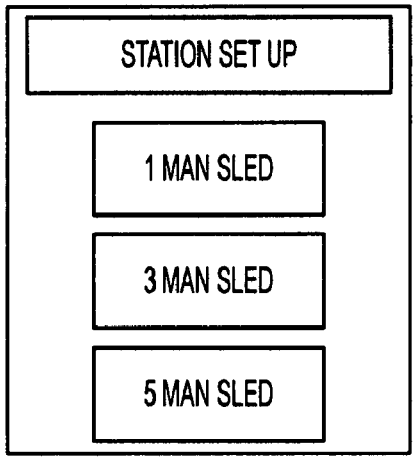
Figure 17E:
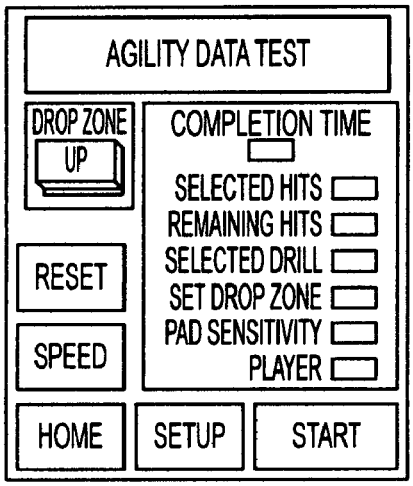
Figure 17F:
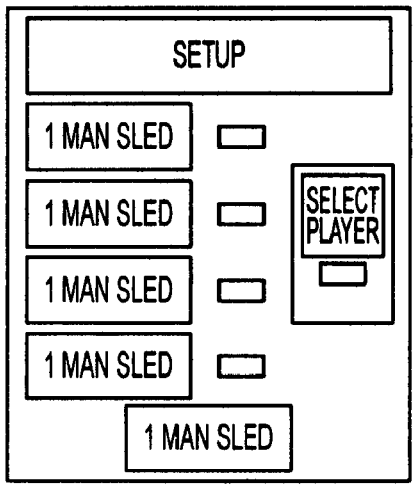
Figure 17G:
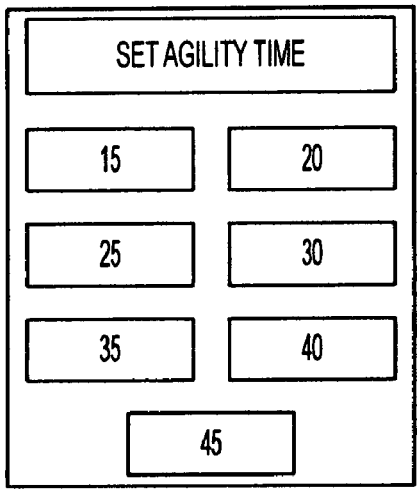
Figure 17H:
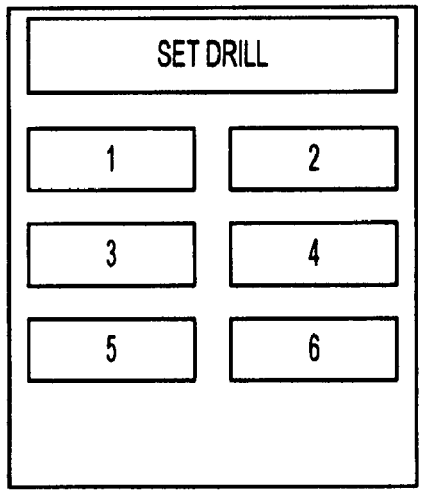
Figure 17I:
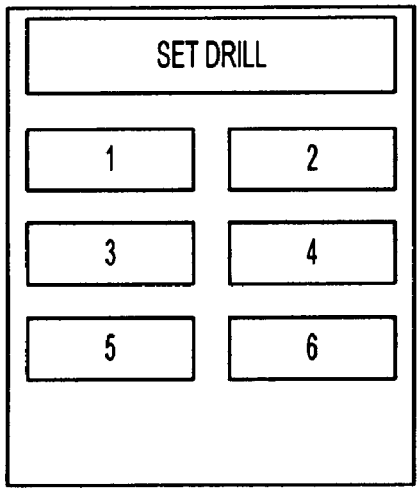
Figure 17J:
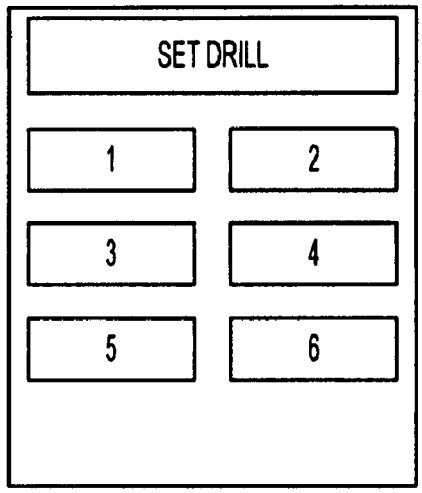
Figure 17K:
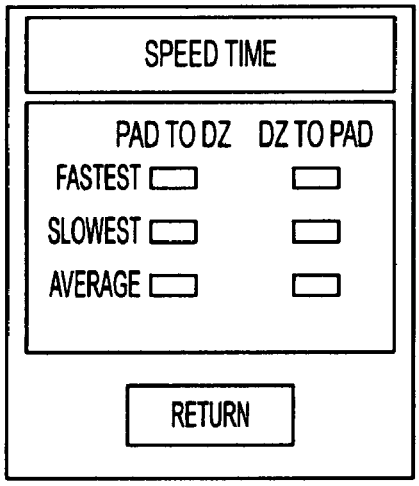
Figure 17L:
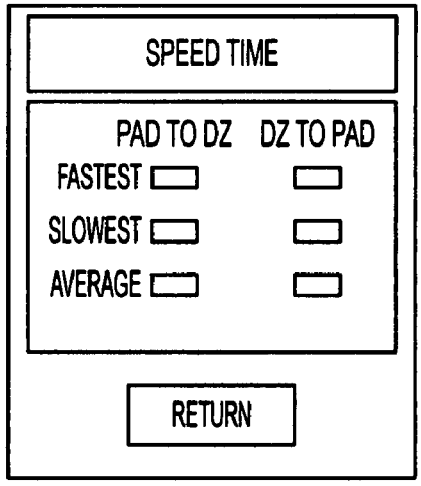
Figure 17M:
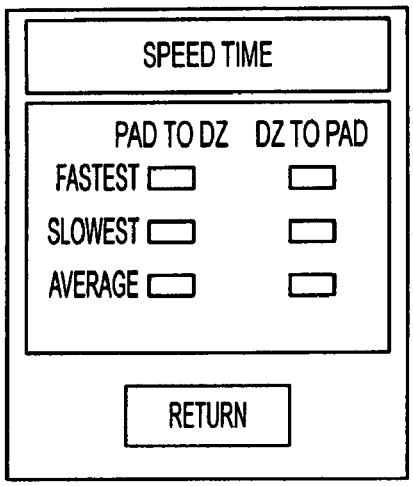
Figure 17N:
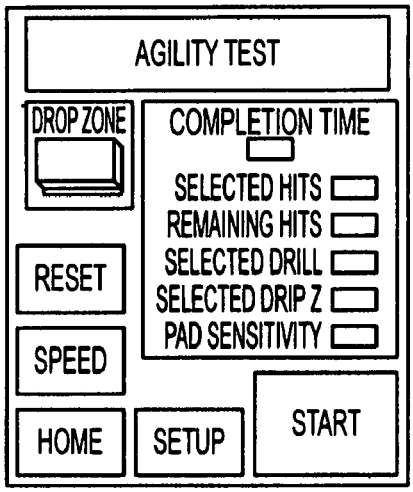
Figure 17O:
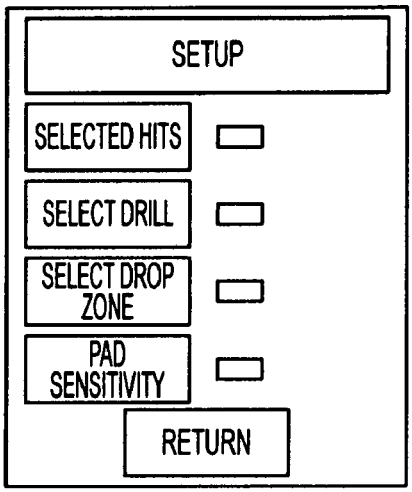
Figure 17P:
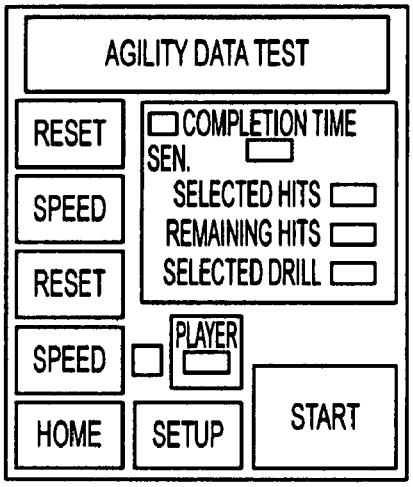
Figure 17Q:
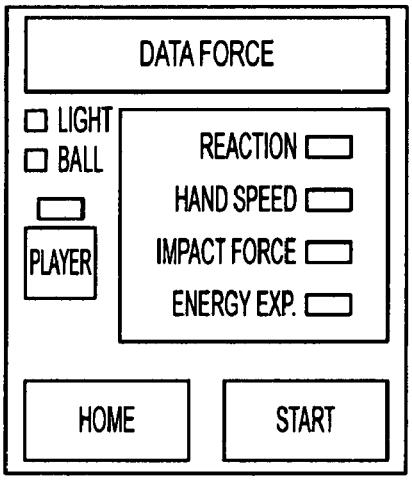
Figure 17R:
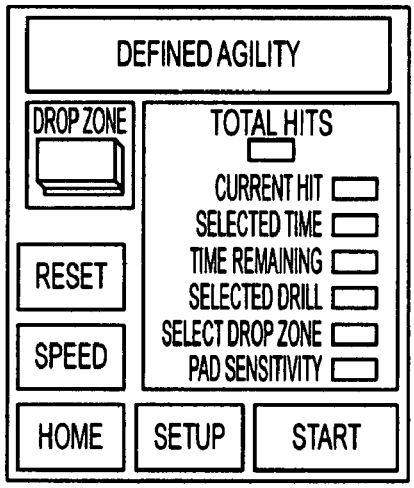
Figure 17S:
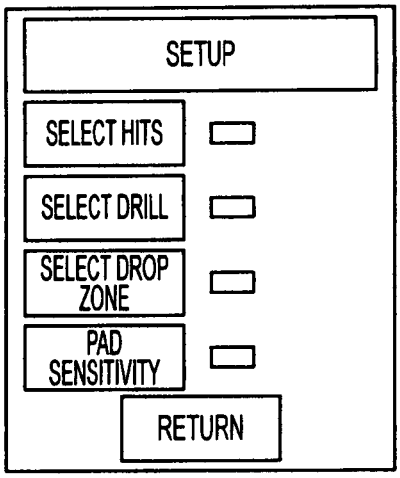
Figure 17T:
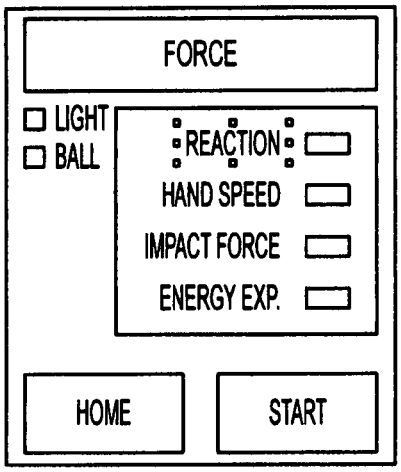
Figure 17U:
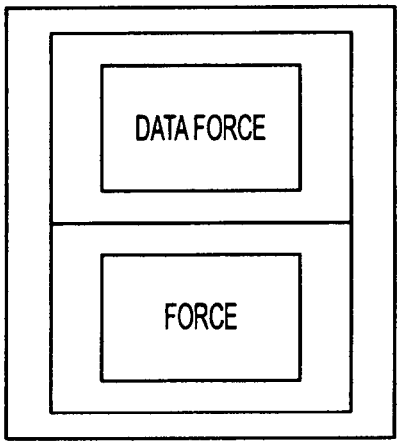
Figure 17V:
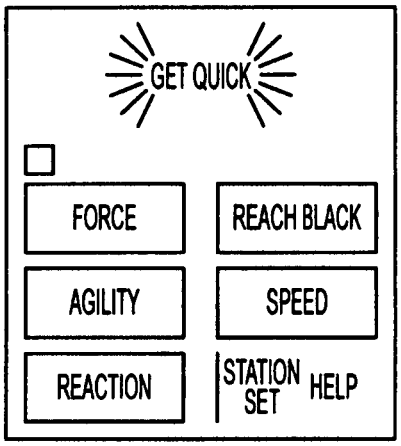
Figure 17W:
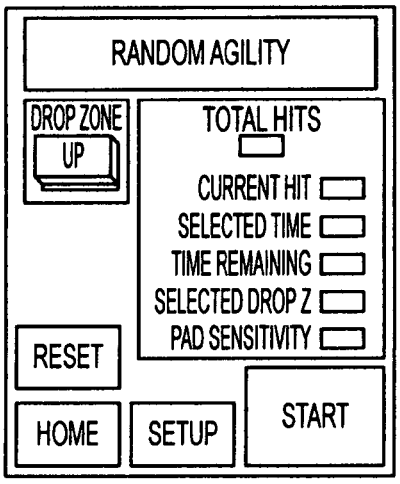
Figure 17X:
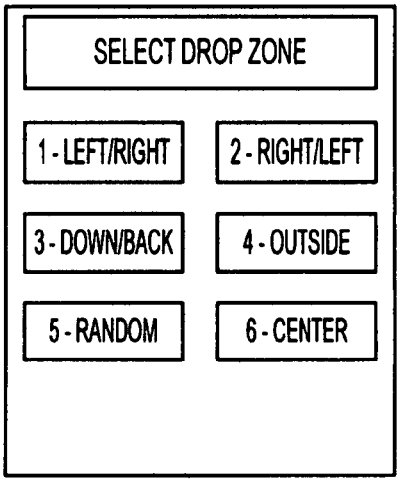
Figure 17Y:
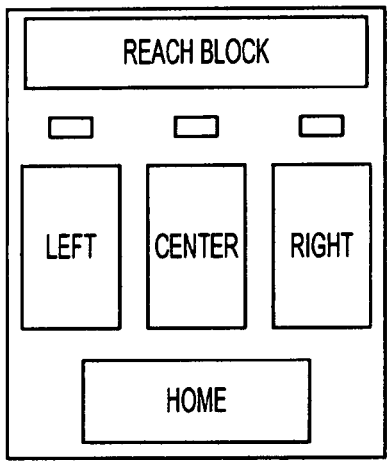
Figure 17Z:
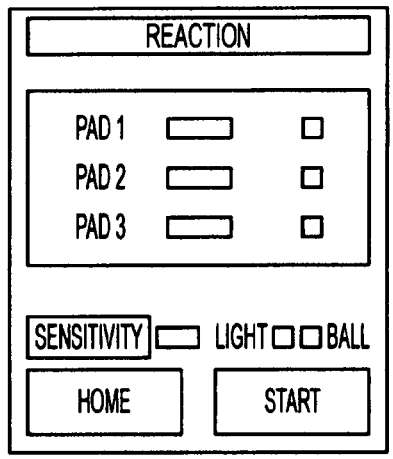
Figure 17A:
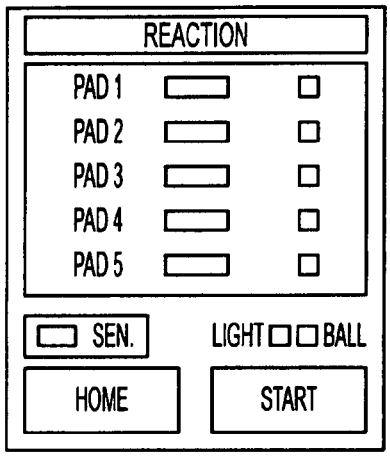
Figure 17B:
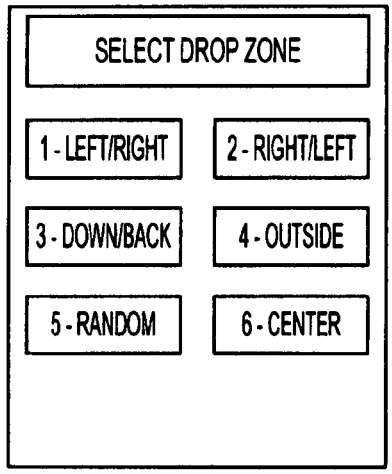
Figure 17C:
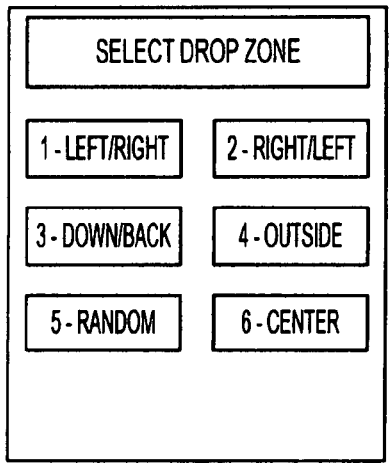
Figure 17D:
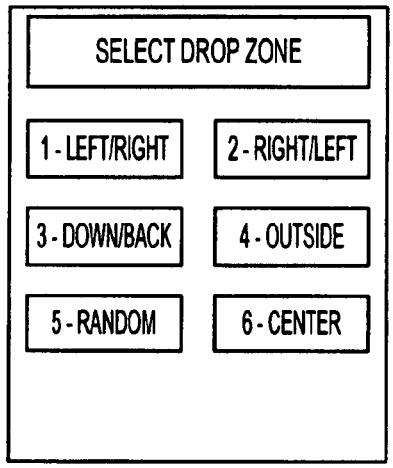

Select drop zone test FIG. 17A
Set Agility FIG. 17B
Shed Drill FIG. 17C
Station set up FIG. 17D
Agility data test-2 FIG. 17E
Agility data test setup FIG. 17F
Agility defined time set FIG. 17G
Agility random time set FIG. 17H
Agility Select Drill FIG. 17I
Agility Select Drill data Test FIG. 17J
Agility Select Drill Test FIG. 17K
Agility Speed FIG. 17L
Agility Speed Data Test FIG. 17M
Agility Speed Test FIG. 17N
Agility Test FIG. 17O
Agility test setup FIG. 17P
Data Agility Test FIG. 17Q
Data Force FIG. 17R
Defined Agility FIG. 17S
Defined agility setup FIG. 17T
Force FIG. 17U
Force select FIG. 17V
Home 3 FIG. 17W
Random Agility FIG. 17X
Random agility setup FIG. 17Y
Reach Block FIG. 17Z
Reaction 3 man FIG. 17AA
Reaction 5 man FIG. 17BB
Select drop zone data test FIG. 17CC
Select drop zone defined FIG. 17DD
Select drop zone random FIG. 17EE Drill Descriptions The following descriptions are based on testing and/or training associated with football. It will be apparent that the drills (or some of them) can be used in connection with other sports, with either individuals or groups of participants.

Reaction:

This drill measures the reaction time of all athletes involved. Two or more athletes are needed for an optimal competitive environment. When the stimulus is initiated (ball, lights, or ball and lights) all athletes are to hit the pad in front of them as fast as possible. The light bar on the pad where the athlete with the fastest reaction time will signal the winner by alternating the two outside lights. The light bar on the pad where the athlete with the slowest reaction time is will display a solid center light. The coach will have all the reaction times of all involved displayed on the handheld along with their respective finishing places.

The start stimulus or "hike signal" can be selected by the coach. The default selection is lights only. Any combination of lights only, ball only or lights and ball may be selected on the touch screen. The coach must touch the start button to initiate the stimuli. The computer detects unmanned station and excludes them from timing and placement.

This drill has been specifically designed t develop hand speed, proper hand placement, strength of punch, reaction time and concentration.

Reach Block:

This drill is designed to simulate a reach or cut-off block. The coach selects "reach block" on the touch screen. Three buttons will be displayed. Each button correlates to the lights on the light bar of each training station. The coach can push any of the three buttons at any time. These buttons represent which direction the opposing player is moving. The reaction time is displayed above the appropriate button. The reach block drill is designed to train the athlete to react quickly to stimulus and to use proper hand placement and footwork.

NOTE: Auxiliary pads 55A must be installed to use this feature

Force:

This drill can only be conducted on the center station (station 3). For consistent testing the pad height must be in the same place for all testing. Different pad heights may be used but due to the way the force is measured the higher the pad the better leverage an athlete has and therefore higher the force readings may result. Hand speed, impact force and total energy along with reaction time and player number are displayed on the handheld and can be logged into your data logging software. (must be in the DATA FORCE screen to log player data.) The start stimulus and set up is the same as in REACTION.

This drill is designed to improve and athletes reaction time, hand quickness, strength of punch and to give a baseline for improvement. It is also designed to increase the athletes total power by forcing good technique and proper footwork. Note: The position of the flow control valve at the base of the center unit can be in any position. There is an automatic override designed into the unit so all test are consistent. The only variable during testing is that the pad height is in the same position as all previous tests.

Agility:

There are three separate types of agility drills. Random, Defined, and Agility test. All drills start in the same location. Station numbers two. Once the drill is selected and properly set up the coach can begin the drill by pressing the start button. The start button will initiate a light sequence. The outside lights will flash at the start point (pad #2) to warn the athlete that the drill is about to begin. When the athlete sees all three lights illuminated they are to begin the drill by pressing on the pad above the illuminated light bar. Once the pad is pressed that light tree will turn off and the next light bar in the sequence will illuminate.

1. Random Agility

In this routine the coach/trainer may select the length of time for the drill to last (e.g. 15 to 45 seconds).

2. Defined Agility

This routine contains six predetermined drills, as follows.

Drill 1: Outside touch pads.

Drill 2: Quick change of direction pads 2 and 3.

Drill 3: Hit All.

Drill 4: Short repeating pattern.

Drill 5: Medium repeating pattern.

Drill 6: Long repeating pattern.

3. Agility Test

The athlete races against the clock to finish the selected number of pads. The Agility Test drills are the same as the Defined Agility drills. Agility Data Test and Agility Test are both the same, except that in the Agility Data Test the athlete's predetermined number must be selected so that the recorded data can be stored in the correct athletes file.

The Agility test setup screen has no player select button.

Drop Zone:

This Agility Drill function is available in all the agility modes. It is designed to get the athlete to accelerate, decelerate, and recognize multiple stimuli, and also to help a coach monitor the athlete's ability to change direction, not just laterally but diagonally and vertically (up and/or down field) as well. The handheld controller will display the most recent athlete's fastest, slowest and average times running to the drop zone cones and coming back from the cones to the touch pads. Accessing this information is possible by pressing the "SPEED" button on the selected agility drill main screen. Another available drop zone function is to not use the remote satellite stations with the photo sensor but to place an object like a traffic cone in the desired position. The lights on the drop zone work the same as with the cones (one function can be turned on, turned off, see FIG. 17S, in the selection box.

Figure 15:
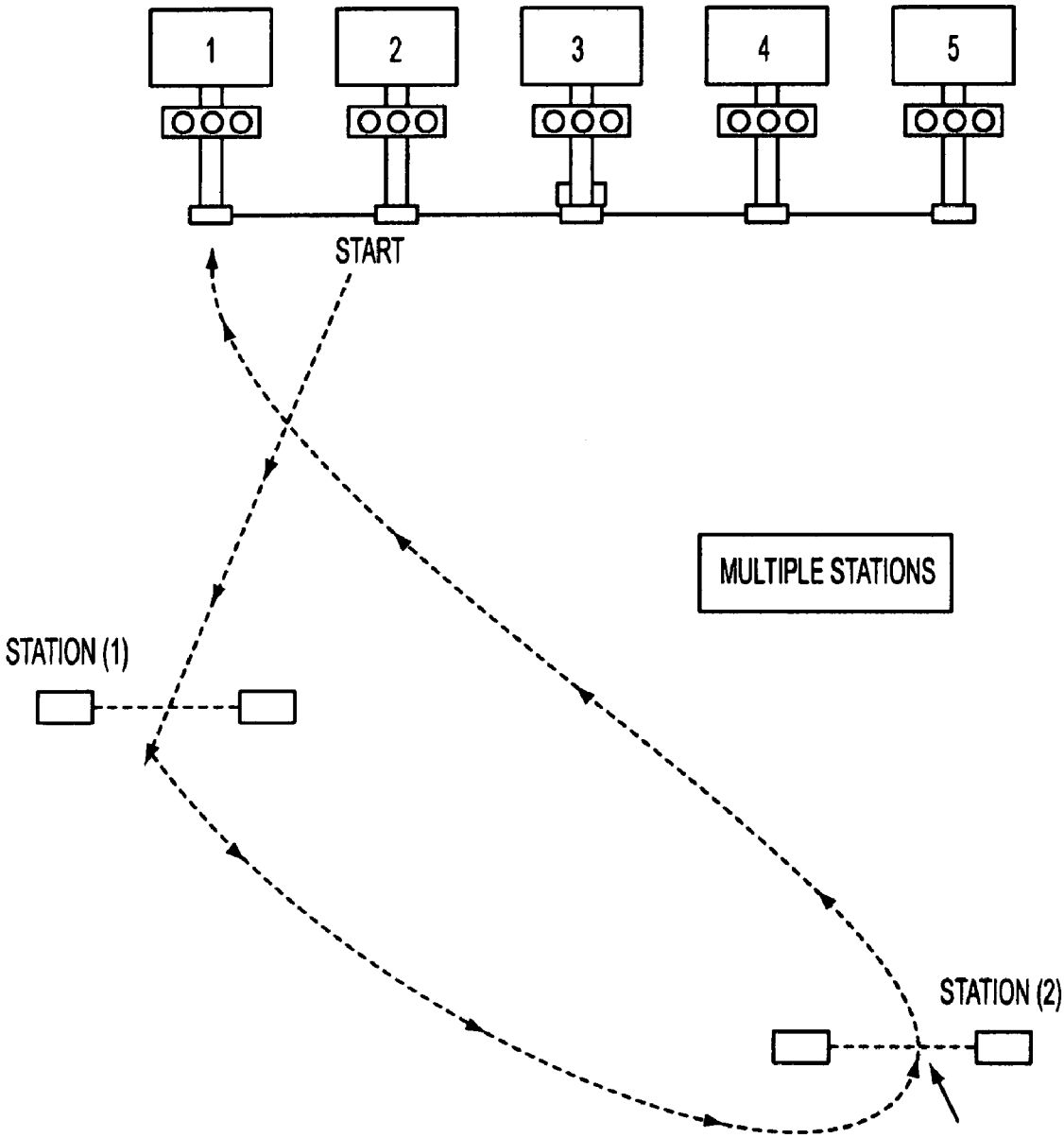

Speed Drill:

The Speed Drill is designed make an athlete quicker from point A to point B, and so on. The satellite station(s) must be used in this drill to measure the athlete's speed from point to point (see FIGS. 14-15). This drill has unlimited uses. Some uses are: improving techniques of blow delivery and escaping a blocker, improving closing speed on a quarterback or ball carrier, and improving proper pursuit angles and conditioning, the timing of a receivers routes, and proper kick step by offensive linemen. Multiple times can be tracked on the handheld controller from any one drill. This information can provide valuable data when comparing and accessing athletes.

Force/Data Force

Force/Data Force Select

Access this screen by touching the "FORCE" button on the HOME screen. From this screen you may workout an athlete by touching the FORCE button or to log force data on an athlete touch the "DATA FORCE" button.

Once in the "DATA FORCE" screen touch the "PLAYER" button and enter the athletes designated number so the testing data can be stored in the selected athletes personal file. The Force and Data Force screens both display the athletes reaction time, hand speed (a measure of how quickly the athlete is able to generate the maximum impact force), impact force (the maximum force imparted to the pad by the athlete), Energy (the measure of the total energy expended during the hit). The start stimulus is also displayed and can be selected by touching the buttons. The coach has the option to use the start stimulus as light only, ball only, or light and ball. A check mark displayed in the window indicates that that particular function is on. The default function is light only.

[Note: The only difference between the "Force" screen and the "Data Force" screen is that "Force" has no "Player" select button.]

Control Center

The control center for the apparatus is designed to be easily removed and stored indoors and charged when not in use. To erect and install it:

1: Place feet of the Control box fit into the holes on the docking station;

2: Secure the Control Box with the hinged twist locks;

3: Plug in the Control Center cord into the plug receiver on the back side of the box next to the docking station; and twist to secure.

4. Then, turn on the power to the Control Center; The colored light will turn on. Allow the unit to boot up (about 30 seconds).

5. Turn on the hand-held IPAQ personal computer (controller).

6: Select the number of stations you are using.

7: The selected number of stations will be displayed on the home screen. If there is an "E" in the window on the MAIN SCREEN then it is necessary to "soft start" the handheld to reestablish communication with the Control Center. (see soft start)

To Uninstall Control Center:

1: Turn of Control Center.

2: Unplug Control Center cord from the docking station and place in dummy receiver.

3: Undo both hinged twist latches and remove Control Center.

4: Place in a secured area and charge.

5: Turn of hand held IPAQ personal computer. (Press top right button) Place on charger.

Soft Start

If at any point communication with the Control Center is lost or a button is hit on the IPAQ hand held computer and can not get back to the Reaction Agility Technique Trainer [R.A.T.T] Elie Training System's main screen, the trainer/coach can soft start the hand held unit controller. This process will reboot the handheld and return to the "Start Up" screen; then.

1: Remove stylus from the IPAQ;

2: Place the tip of the stylus into the soft start hole in the bottom left corner of the IPAQ hand held controller, upon which a screen will start to load. When the hand held is finished reloading, the Start up screen will be displayed;

3: Select the number of units currently being used.

Touch Screen/Drill Operation

All drills are accessible from this "Home" screen. Some units may require selection of the proper trainer profile to be used before accessing the "Home" screen. Also, the proper profile must be selected after start up or if communication has been lost and it is necessary to perform a "Soft Start on the hand held computer (see "soft start" in the "control center" section).

While the methods herein described, and the forms of apparatus for carrying these methods into effect, constitute preferred embodiments of this invention, the invention is not limited to these precise methods and forms of apparatus, and that changes may be made in either without departing from the scope of the invention as defined in the claims.

What is claimed is:

1. Apparatus for testing and improving agility and response time of persons such as athletes, comprising means defining at least one station including a fabricated base having a front and a back, pivot mount means on said base adjacent said front of said base, a generally upright post having a lower and an upper end and supported at its lower end on said pivot mount means to define motion of said upper end of said post toward and away from said back of said base, a touch pad supported on said post for vertical adjustment toward and away from said pivot mount means, said touch pad providing a target for hits against said pad by a person working out on the apparatus, a resistance means connected to said lower end of said post and anchored to said base extending away from said pivot mount to urge said post into an upright position above said pivot means, said resistance means being constructed and adapted to permit limited rearward motion of said post in response to an impact against said touch pad, a programmable controller connected to operate said apparatus, means connected to said controller for providing a starting stimulus for initiation of a program to run on said apparatus and, means connected to said controller for sensing an initial hit on said touch pad and providing a first timing signal to said controller and a second timing signal to said controller response to end of motion of said post, whereby results of the elapsed time and of the effect of the hit can be calculated by the controller.

2. Apparatus as defined in claim 1, further including display means interconnected with said controller for displaying images showing the results.

3. Apparatus as defined in claim 2, further including in the images an identification of the person using the apparatus.

4. Apparatus as defined in claim 2, wherein said display means is a touch screen device communicating with said controller.

5. Apparatus as defined in claim 4, wherein the display means communicates with said controller via wireless transmission/reception.

6. Apparatus as defined in claim 5, wherein at least two of said stations are provided and are independently usable and are separately connected for communication with said controller.

7. Apparatus as defined in claim 5, where said at least two stations are supported side-by-side on said base for selective use by two or more persons, whereby program routines can be simultaneously performed by multiple persons, as for competitive purposes.

8. Apparatus as defined in claim 1 wherein said means defining a station includes at least one signal light on each of the stations.

9. Apparatus as defined in claim 1, including at least one satellite station structurally independent of said apparatus and having self-contained power and a wireless transmitter/receiver for communicating with said controller, said satellite station also containing a proximity detector means for detecting near presence of a person following a routine which includes excursion away from and back to said apparatus.

10. Apparatus as defined in claim 1, wherein at least one passive marker is employed to designate a location remote from the at least one station and defining a path in selected drill routine.

11. Apparatus as defined in claim 1, wherein said touch pad is adjustable in a vertical direction on its post to accommodate the stature of user persons.

12. Apparatus as defined in claim 1 wherein the post of said station is provided with outrigger extension arms projecting sideways from its post, and an auxiliary touch pad is mounted on said outrigger extension to provide for sequential touching of the central and auxiliary pads, as in the case of simulating a reach block.

13. Apparatus as defined in claim 1, wherein said post includes upper and lower telescoping post sections having mating irregular cross-section shapes providing a torque resistant structure that prevents appreciable twisting of a target, such as might result from an off-center hit against the target pad.

14. Apparatus as defined in claim 13, further including a variable rate spring means included in said coupling to contribute to the resistance means.

15. Apparatus as defined in claim 13, further including a transducer sensing the pressure in said hydraulic cylinder and transmitting a corresponding signal to the programmable controller.

16. Apparatus as defined in claim 13, further including a rotary encoder driven from the motion of said rod and functioning to provide to the programmable controller a signal related to the length of motion of said rod and the rate of acceleration of said rod.

17. Apparatus as defined in claim 13, comprising means to disable said valve in said bypass conduit and establish instead a bypass orifice of fixed predetermined flow rate.

18. Apparatus as defined in claim 1, wherein said resistance means includes a hydraulic cylinder having a rod attached by a coupling to said post, the ends of said cylinder being connected by a bypass conduit, and an adjustable valve in said conduit for controlling the rate of flow of hydraulic fluid between the opposite ends of said cylinder.

19. A method of testing/training athletes and other selected users by directing them through a predetermined drills and sensing their performances comprising the steps of:

a) linking a programmable computer controller with a memory device and a compatible touch-screen portable display device to each other using software which enables the portable device to display visual data representing selected drill sequences and also enables the portable device to direct the computer controller in selection and performance of desired drill performances, b) transmitting inputs from touch pads, force resistance mechanisms, movement detector, and a rate of movement encoder from a testing apparatus to the computer controller, c) creating in the memory of said computer controller sets of instructions defining drills which involve touching and/or hitting at least one touch pad, and/or running along predetermined paths, d) selecting a desired drill instruction and activating the controller to perform a corresponding drill, d) directing the user(s) in performing the requirement of the selected drill, e) displaying the results upon completion of the drill by at least one user.

20. The method defined in claim 19, further including f) using satellite stations in conjunction with the testing/training equipment to expand the territorial execution of the drills.

21. The method defined in claim 19, further comprising g) storing the completed drill results in memory together with identification of the user(s), h) displaying the results, and i) printing the results on demand.

* * * * *